US006760565B2

(12) United States Patent
Watanabe et al.

(10) Patent No.: US 6,760,565 B2
(45) Date of Patent: Jul. 6, 2004

(54) IMAGE FORMING APPARATUS AND METHOD IN WHICH A TRANSFER MEDIUM TRANSFERS A DEVELOPER IMAGE AT A DIFFERENT SURFACE VELOCITY THAN A RECORDING MEDIUM

(75) Inventors: Takeshi Watanabe, Ichikawa (JP); Koichi Ishii, Kawasaki (JP); Hitoshi Yagi, Yokohama (JP); Mitsunaga Saito, Ichikawa (JP); Masahiro Hosoya, Okegawa (JP); Yasushi Shinjo, Kawasaki (JP); Haruhi Oooka, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/084,634

(22) Filed: Feb. 28, 2002

(65) Prior Publication Data

US 2002/0164177 A1 Nov. 7, 2002

Related U.S. Application Data

(63) Continuation-in-part of application No. 09/662,829, filed on Sep. 15, 2000, now Pat. No. 6,389,242.

(51) Int. Cl.[7] ..... G03G 15/16; G03G 15/10

(52) U.S. Cl. ..... 399/308; 399/237

(58) Field of Search ..... 399/237, 249, 399/250, 251, 307, 308; 430/117

(56) References Cited

U.S. PATENT DOCUMENTS

| | | | | | |
|---|---|---|---|---|---|
| 4,894,687 | A | | 1/1990 | Beaudet | 399/307 |
| 5,708,938 | A | | 1/1998 | Takeuchi et al. | 399/250 |
| 5,890,045 | A | | 3/1999 | Till et al. | 399/308 |
| 6,077,636 | A | * | 6/2000 | Moriki et al. | 430/45 |
| 6,522,853 | B2 | * | 2/2003 | Iida et al. | 399/249 |
| 2003/0044203 | A1 | * | 3/2003 | Watanabe | 399/302 |

FOREIGN PATENT DOCUMENTS

| | | |
|---|---|---|
| JP | 5-303295 | 11/1993 |
| JP | 8-248728 A | 9/1996 |
| JP | 8-254907 | 10/1996 |
| JP | 9-106201 | 4/1997 |
| JP | 2000-330358 | 11/2000 |

* cited by examiner

*Primary Examiner*—Sophia S. Chen
(74) *Attorney, Agent, or Firm*—Foley & Lardner LLP

(57) ABSTRACT

An image forming apparatus includes an optical unit which forms an electrostatic latent image on a surface of a photosensitive body, a developing device which supplies a liquid developer on the electrostatic latent image formed by the optical unit, and develops the electrostatic latent image into a develop image, a condensing device which condenses the developer image, and a transfer device which transfers the developer image condensed by the condensing device to a recording medium, while applying a shearing stress to the developer image.

3 Claims, 15 Drawing Sheets

IMAGE FORMING APPARATUS AND METHOD IN WHICH A TRANSFER MEDIUM TRANSFERS A DEVELOPER IMAGE AT A DIFFERENT SURFACE VELOCITY THAN A RECORDING MEDIUM

CROSS-REFERENCE TO RELATED APPLICATIONS

This is a Continuation-In-Part application of U.S. patent application Ser. No. 09/662,829, filed Sep. 15, 2000 now U.S. Pat. No. 6,389,242, the entire contents of which are incorporated herein by reference.

BACKGROUND OF THE INVENTION

The present invention relates to a wet image forming method and apparatus applied to, e.g., an electrophotographing apparatus or electrostatic recording apparatus to form an image using a liquid developer.

A wet image forming apparatus using a liquid developer comprising toner particles and solvent can use very fine toner particles on the submicron order, which cannot be used in a dry image forming apparatus. Thus, it can realize high image quality.

Toner particles comprise resin and pigment. Dry-type toner particles have a higher ratio of pigment to resin, than dry-type toner particles. This apparatus is economical since a sufficiently high image density can be obtained with a small amount of toner.

Wet image forming apparatuses and methods are disclosed in, e.g. U.S. Pat. Nos. 5,255,058, 5,276,492, 5,028,964, 5,636,349, 4,728,983, 5,061,583, and 5,570,173.

A conventional wet image forming apparatus has several problems, and one of them is degradation in image quality of a transfer image.

Conventionally, since a toner image attached to the photosensitive body is directly transferred to a sheet with an electric field, transfer non-uniformity occurs due to variations in electric field corresponding to the unevenness on the surface of the sheet. This results in degradation of image quality.

In addition, defective transfer tends to occur due to variations in the environment, e.g. temperatures and humidity at the location of use of the image forming apparatus, or in the electric characteristics of the sheet.

Solutions to these problems are disclosed, for instance, in U.S. Pat. Nos. 5,148,222, 5,166,734 and 5,208,637. In the apparatus disclosed therein, a toner image is once transferred from the photosensitive body to an intermediate transfer medium, and then the image is transferred from the intermediate transfer medium to a recording medium such as paper, using pressure or pressure and heat.

It is relatively easy to form the intermediate transfer medium of a material having surface smoothness and less variation in electric resistance. Thus, compared to the case of directly transferring the toner image onto paper with an electric field, the degradation in image quality of the transfer image can greatly be improved.

Moreover, the solvent in the toner image attached to the intermediate transfer medium can be evaporated by heat or sucked away by air before the toner image is transferred to the sheet. Thus, the amount of solvent attached to the paper can be reduced.

Jpn. Pat. Appln. KOKOKU Publication No. 46-41679, Jpn. Pat. Appln. KOKAI Publication No. 62-280882, etc. disclose apparatuses that do not employ electric field transfer but employs transfer by pressure or transfer by pressure and heat in both the transfer of the toner image from the photosensitive body to the intermediate transfer medium and the transfer from the intermediate transfer medium to the paper.

However, even if the toner image is transferred to the paper by pressure or by pressure and heat, as mentioned above, the occurrence of toner remaining after transfer cannot completely be prevented, and satisfactory transfer efficiency cannot be obtained.

BRIEF SUMMARY OF THE INVENTION

The present invention has been made in view of the situations described above, and its object is to provide an image forming method and image forming apparatus in which a developer image is transferred with a shearing stress, thus enhancing the transfer efficiency of the developer image.

According to an aspect of the present invention, there is provided an image forming method comprising: forming an electrostatic latent image on a surface of an electrostatic latent image carrying body; supplying a developer on the electrostatic latent image, and developing the electrostatic latent image into a developer image; and transferring the developer image from the electrostatic latent image carrying body to a recording medium, while applying a shearing stress to the developer image.

According to another aspect of the invention, there is provided an image forming apparatus comprising: a latent image forming device which forms an electrostatic latent image on a surface of an electrostatic latent image carrying body; a developing device which supplies a liquid developer on the electrostatic latent image formed by the latent image forming device, and develops the electrostatic latent image into a developer image; a condensing device which condenses the developer image; and a transfer device which transfers the developer image condensed by the condensing device to a recording medium, while applying a shearing stress to the developer image.

According to still another aspect of the invention, there is provided an image forming apparatus comprising: a latent image forming device which forms an electrostatic latent image on a surface of an electrostatic latent image carrying body; a developing device which supplies a liquid developer on the electrostatic latent image formed by the latent image forming device, and develops the electrostatic latent image into a developer image; a transfer device which transfers the developer image developed by the developing device from the electrostatic latent image carrying body to an intermediate transfer medium, and then transfers the developer image from the intermediate transfer medium to a recording medium; and a condensing device which condenses the developer image transferred on the intermediate transfer medium, wherein a shearing stress is applied to the developer image during at least one of a time of transferring the developer image from the electrostatic latent image carrying body to the intermediate transfer medium and a time of transferring the developer image from the intermediate transfer medium to the recording medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will be described with reference to the embodiments shown in the accompanying drawing.

Figure 1:
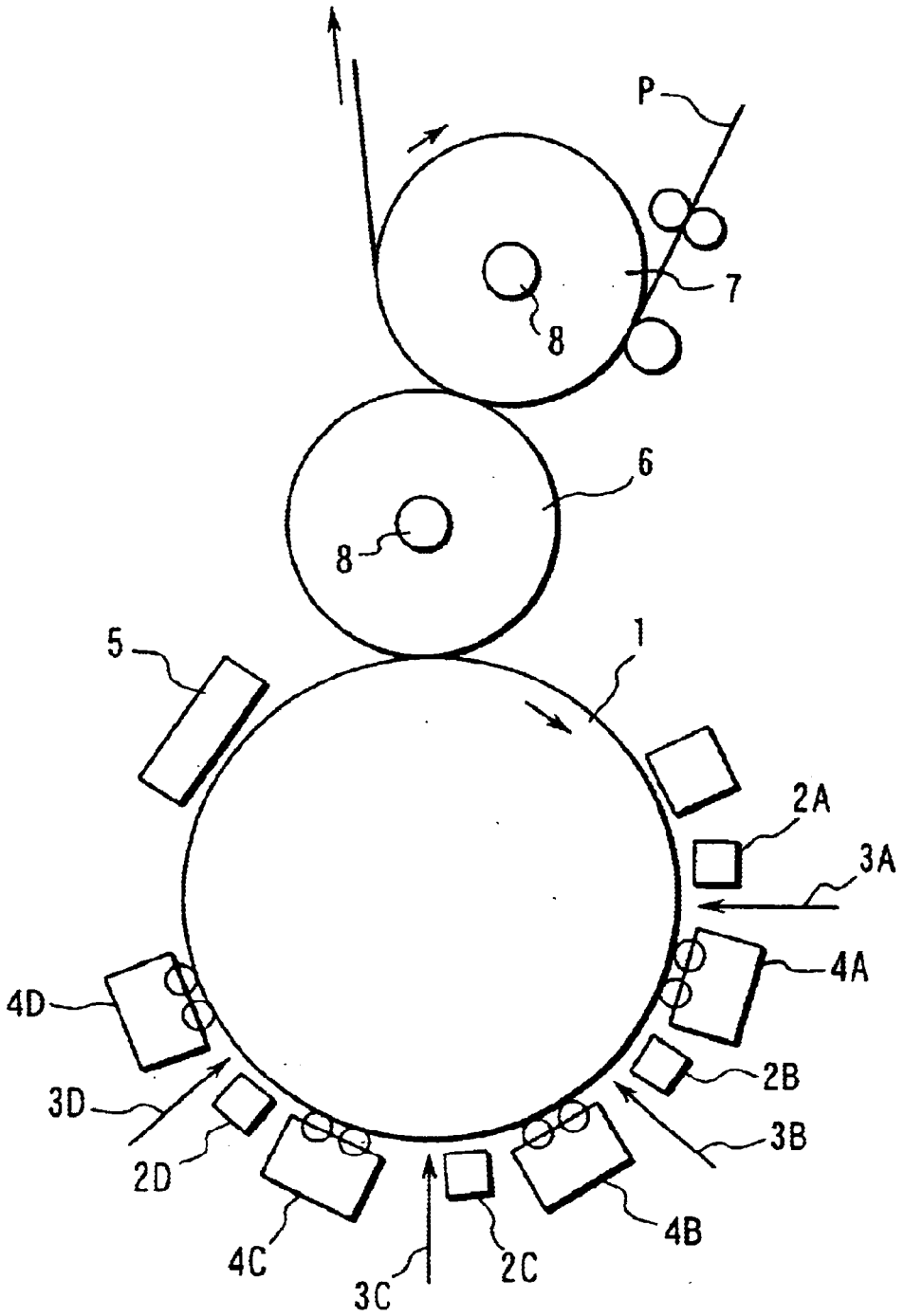
FIG. 1 is a view showing the arrangement of a wet electrophotographing apparatus according to a first embodiment of the present invention.

FIG. 1 is a view showing the internal arrangement of a wet electrophotographing apparatus as an image forming apparatus according to one embodiment of the present invention.

Referring to FIG. 1, an organic- or amorphous silicon-based photosensitive layer is formed on a conductive base to form a photosensitive drum 1 serving as an image carrier. The surface of the photosensitive drum 1 is uniformly charged by a known corona or scorotron charger 2A and is subjected to exposure 3A by an image-modulated laser beam to form an electrostatic latent image. After that, the electrostatic latent image is visualized by a developing device 4A storing a liquid developer. As the liquid developer, for example, one obtained by dispersing metallic soap for charging control and a pigment-added acrylic resin or the like with a glass transition temperature (Tg) of −50° C. to 70° C. to a hydrocarbon-based insulating solvent, e.g., Isopar G, L, or M, or Norpar 12, 13, or 15 (Tradename) available from Exxon, can be used.

FIG. 1 also shows chargers 2C, 3C, 4C, as well as developing devices 2D, 3D and 4D.

The liquid developer or toner attaching to the electrostatic latent image may directly reach a pre-transfer dryer 5 to dry its solvent to a certain degree, and after that may be primarily transferred to an intermediate transfer medium 6. In this embodiment, however, the second electrostatic latent image is successively formed by a second charger 2B and second laser exposure 3B, and is developed by a second developing device 4B storing the second developer with a color different from that stored in the developing device 4A.

Therefore, after second development, a two-color toner image is formed on the image carrier 1. In the same manner, third and fourth charging, exposure, and development operations are performed to form a full-color toner image on the photosensitive drum 1.

After that, the toner image is dried by the dryer 5 to a certain degree, and is continuously transferred onto the intermediate transfer medium 6. The intermediate transfer medium 6 is formed by coating a metal roller with silicone rubber or urethane rubber to a thickness of 0.1 to 5 mm. The surface hardness of the intermediate transfer medium 6 is 1° to 70° (JIS-A).

Preferably, a silicone- or fluorine-based mold release layer is formed to a thickness of 0.1 $\mu$m to 5 $\mu$m, on the photosensitive layer provided on the photosensitive drum 1. The surface energy of the mold release layer is 15 dyne/cm to 30 dyne/cm when converted from a value measured from the contact angle of Isopar L and pure water. Nonetheless, no mold release layer may be formed on the photosensitive layer. Even in this case, an image can be transferred to the intermediate transfer medium only if the intermediate transfer medium is one that serve this purpose.

To prepare the liquid toner, an acrylate-based copolymer, a dispersant, and the like were added to Isopar L. The resultant mixture was mixed and dispersed in a paint shaker in the presence of glass beads, thereby preparing a condensed liquid developer. The obtained condensed developer was diluted with Isopar L such that the concentration of its nonvolatile component became 1 wt %. Fifty wt % of zirconium naphthenate (with a nonvolatile component of 49 wt %) manufactured by DAINIPPON INK & CHEMICALS, INC. was added to the nonvolatile component of the liquid developer described above.

As the pigment to be added to the toner particles, for example, if the toner is cyan toner, Cyanin Blue KRO manufactured by SANYO COLOR WORKS, Ltd. was used, and the weight ratio of the resin to the pigment was set to 4:1. The glass transition temperature of the toner was set to approximately 45° C., and the surface temperature of the photosensitive body 1 was set to room temperature (20° C. to 30° C.). The pre-transfer dryer 5 blew air to the toner image and the photosensitive body 1 to dry the toner image to a certain degree.

In this state, the silicone intermediate transfer medium 6 with a hardness of about 50° was pressed against the surface of the photosensitive drum 1 and was rotated. Good primary transfer was possible. The contact pressure between the photosensitive body 1 and intermediate transfer medium 6 is preferably applied with a linear pressure of approximately 0.1 kg/cm to 20 kg/cm in the longitudinal direction of the photosensitive drum 1.

The toner image transferred onto the intermediate transfer medium 6 is secondarily transferred to the surface of a sheet P or the like serving as a transfer target by a backup roller 7 constituting a transfer unit. The backup roller 7 and intermediate transfer medium 6 have heaters 8, so they are heated to the glass transition temperature or more (45° C. in this case) of the toner. The heated toner image on the intermediate transfer medium 6 reaches a secondary transfer region, where the sheet P is sandwiched by the intermediate transfer medium 6 and backup roller 7. A load corresponding to a linear pressure of 0.2 kg/cm to 20 kg/cm in the longitudinal direction is applied to the sheet P, thereby transferring the image to the sheet P.

Figure 2:
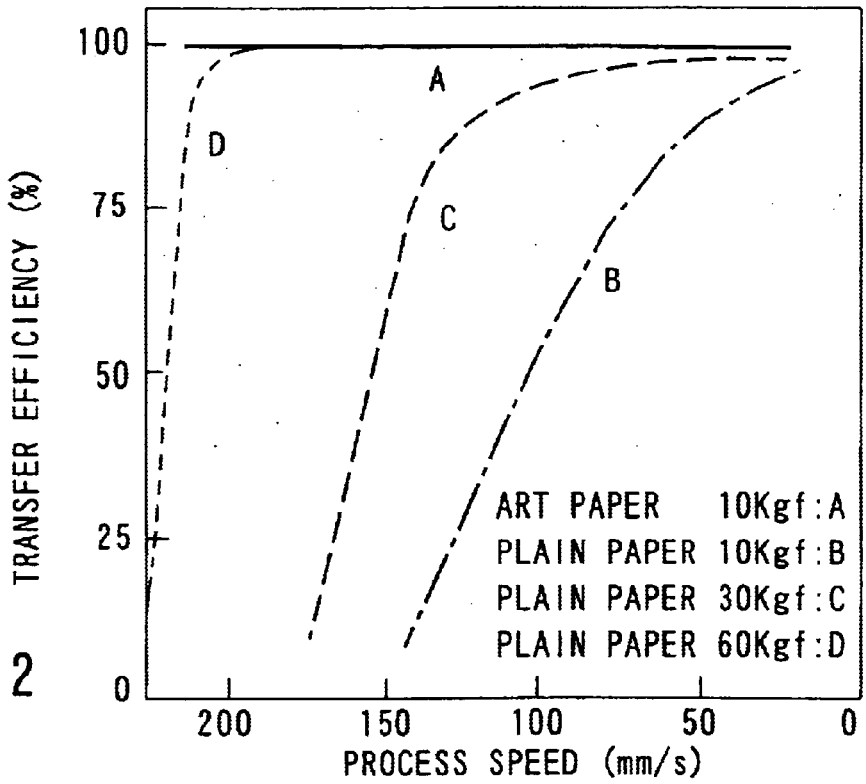
FIG. 2 is a graph showing the transfer characteristics of art paper and plain paper in comparison.

FIG. 2 is a graph showing the transfer characteristics of art paper and plain paper in comparison.

In FIG. 2, the axis of abscissa represents the process speed, and the axis of ordinate represents the transfer efficiency. According to FIG. 2, for art paper, when the secondary transfer load is about 10 kgf (the load on the total length of 270 mm in the longitudinal direction of A4-size paper) and the process speed is 200 mm/s, the transfer efficiency becomes substantially 100%.

For plain paper, when transfer is performed with the same conditions as those described above, the transfer efficiency becomes substantially 0%. Even for plain paper, when the load is increased to 60 kgf, transfer can be performed substantially 100%. Even if the load is not increased, a transfer efficiency of almost 100% can be obtained by extremely decreasing the process speed to 20 mm/s.

Figure 3:
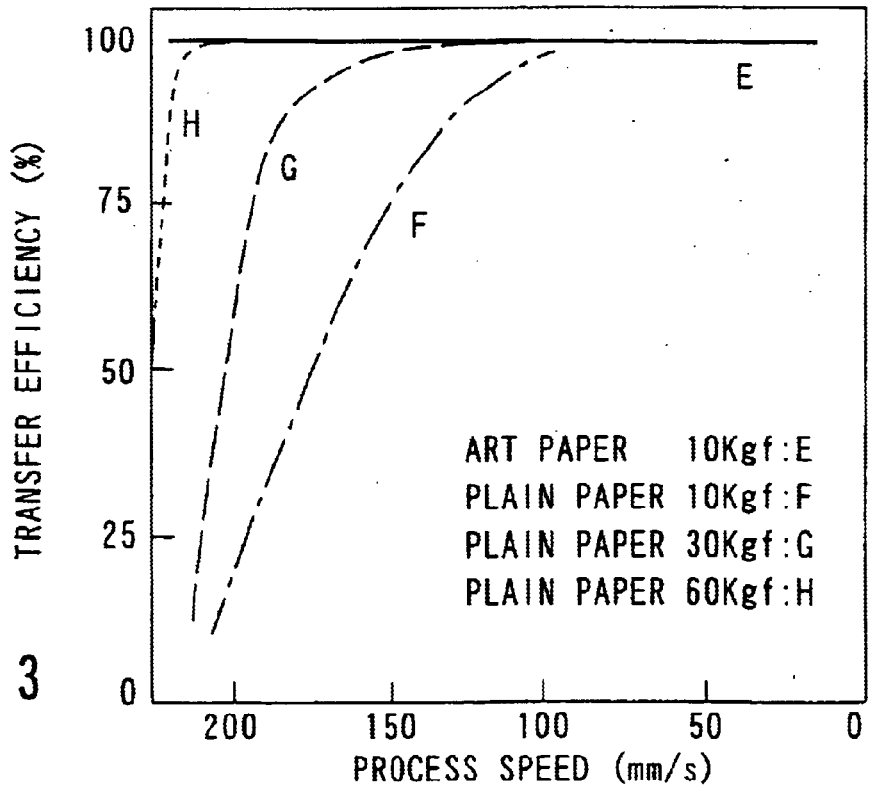
FIG. 3 is a graph showing the transfer characteristics obtained when a toner image is transferred from a photosensitive body to an intermediate transfer medium with an electric field.

These characteristics largely change depending on primary transfer methods. For example, in an apparatus that performs primary transfer with an electric field, the mold release properties of the surface of the intermediate transfer medium 6 can be increased to be higher than that obtained with an apparatus that performs primary transfer by the offset method. A result as shown in FIG. 3 is accordingly obtained. More specifically, secondary transfer can be performed more advantageously, and a load necessary for plain paper can be slightly decreased. Nevertheless, a necessary load still differs between plain paper and art paper, and an effect can be obtained by employing the present invention, as a matter of course.

As the adjustment range of the pressure, if the average pressure applied within the transfer nip is 1 kg/cm$^2$ or more, good transfer can be performed in most cases. Plain paper, however, requires a pressure of 10 kg/cm$^2$ or more, and a higher pressure is sometimes necessary depending on the types of intermediate transfer media 6 or the sheets on which transfer is to be performed. Particularly, when the transfer speed is increased, a high pressure becomes necessary. For example, the transfer speed is higher than 400 mm/s, a pressure of about 50 kg/cm$^2$ is sometimes necessary.

Figure 4:
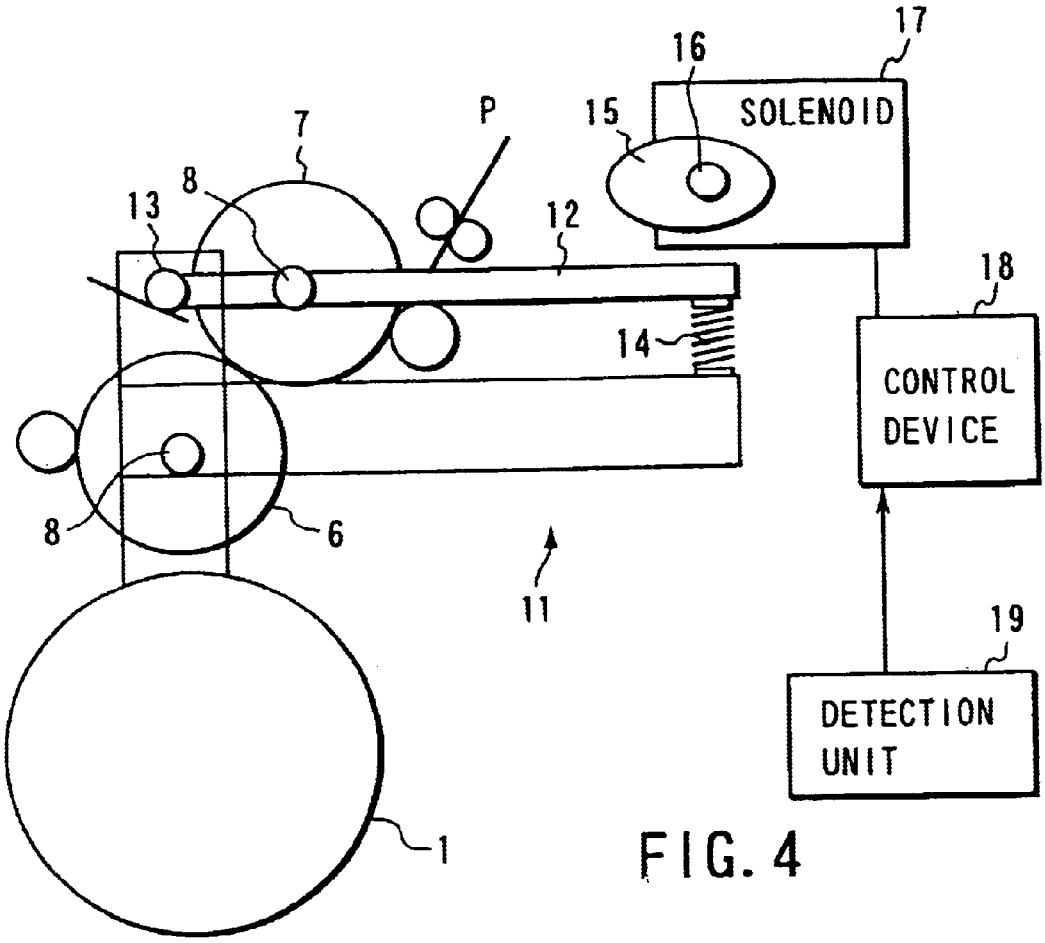
FIG. 4 is a view showing the arrangement of a changing device which variably controls the pressing force of the sheet against the intermediate transfer medium.

FIG. 4 shows a changing device 11 for variably controlling the pressing force of the sheet against the intermediate transfer medium 6.

The changing device 11 has an arm 12 with one end side attached with the backup roller 7. One end of the arm 12 is pivotally supported by a support shaft 13. The other end of the arm 12 is biased upward by a spring member 14.

A cam member 15 is provided above the other end of the arm 12 and is connected to a solenoid 17 through a driving shaft 16. The solenoid 17 is connected to a control device 18 through a control circuit. The control device 18 is connected to a detection unit 19 serving as a determining means through a signal line. The detection unit 19 detects the type of sheet and transmits detection information to the control device 18. The control device 18 operates the solenoid 17 in accordance with the detection information transmitted from the detection unit 19.

The operation of the changing device 11 will be described.

When no paper is to be passed, as shown in FIG. 4, the cam 15 is pivoted by the solenoid 17 to the horizontal state to be separated from the arm 12. Thus, the arm 12 is biased upward by the spring 14 and pivots upward about the support fulcrum 13 as the center. This pivot operation moves the backup roller 7 upward to separate it from the intermediate transfer medium 6.

Figure 5:
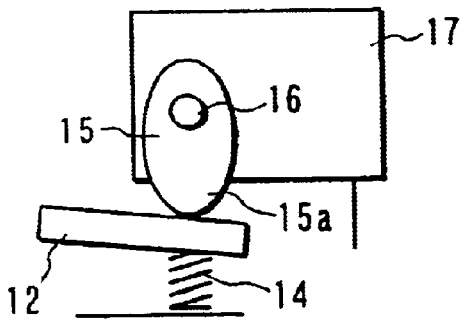
FIG. 5 is a view showing the operation of the changing device when plain paper is to be passed.

When plain paper is to be passed, detection information indicating that plain paper is detected is transmitted from the detection unit 19 to the control device 18 to operate the solenoid 17. Thus, as shown in FIG. 5, the cam 15 is pivoted downward, and its long portion 15*a* pivots the arm 12 downward against the biasing force of the spring 14. The arm 12 deflects as it pivots downward, whereby the backup roller 7 strongly press the plain paper to the intermediate transfer medium 6.

Figure 6:
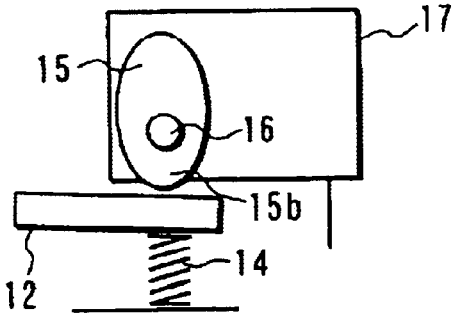
FIG. 6 is a view showing the operation of the changing device when art paper is to be passed.

When art paper is to be passed, detection information indicating that art paper is detected is transmitted from the detection unit 19 to the control device 18 to operate the solenoid 17. Thus, as shown in FIG. 6, the cam 15 is pivoted downward. When the cam 15 pivots, it pivots the arm 12 downward with its short portion 15*b* against the biasing force of the spring 14. When the arm 12 pivots downward, the backup roller 7 weakly urges art paper against the intermediate transfer medium 6.

Figure 7:
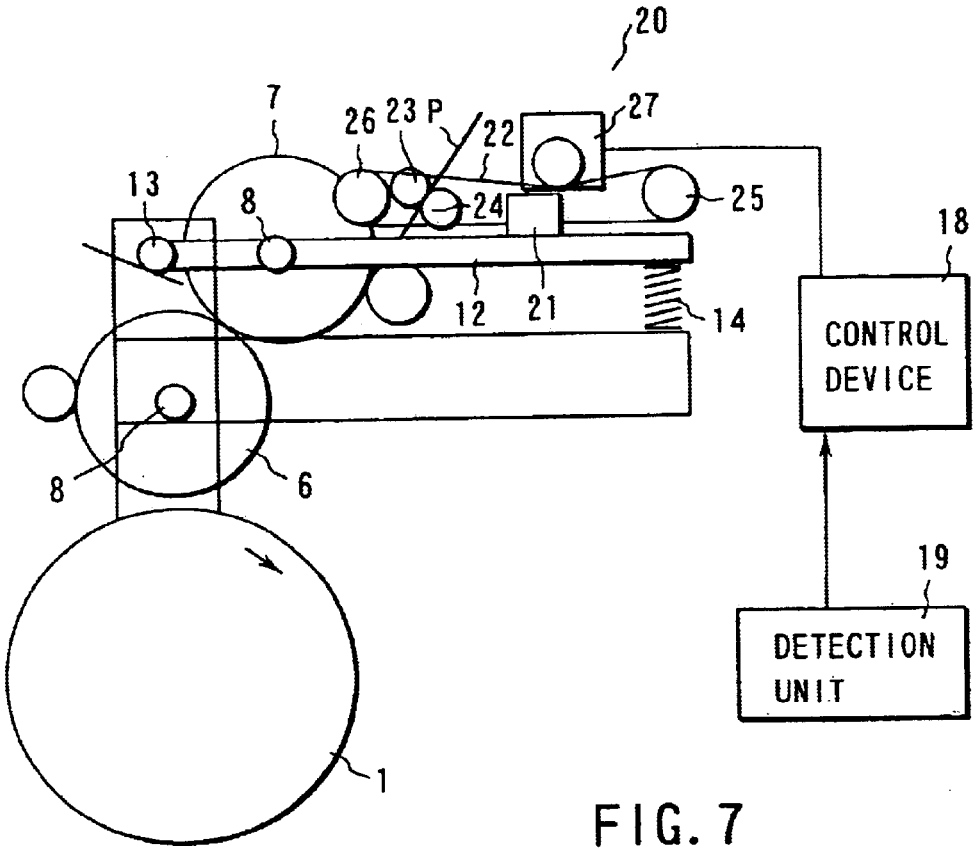
FIG. 7 is a view showing a second example of the arrangement of the changing device.

FIG. 7 is a view showing a changing device which is the second embodiment of the invention.

In the changing device 20, i.e., the second embodiment, a weight 21 is slidably provided along the upper surface of the arm 12, and is connected to a driving belt 22. The driving belt 22 extends between rollers 23 and 24 and is moved by a driving motor 27 to travel in the forward and backwards directions. The driving motor 27 is connected to the control device 18 similar to that described above, and the control device 18 is connected to the detection unit 19.

When art paper P is to be passed, detection information indicating that art paper is detected is transmitted from the detection unit 19 to the control device 18 to rotate the driving motor 27. When the driving motor 27 is rotated, the weight 21 is moved to be located at substantially the intermediate portion between the rollers 25 and 26. When the weight 21 is moved, the backup roller 7 is abutted against the intermediate transfer medium 6 with a weak force to urge the art paper P against the intermediate transfer medium 6 with a weak force.

Figure 8:
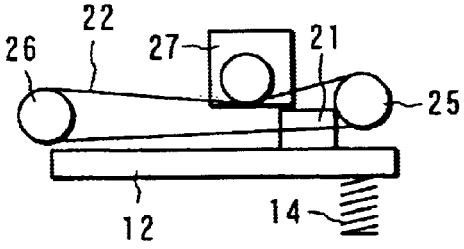
FIG. 8 is a view showing the operation when plain paper is to be passed.

When plain paper is to be passed, detection information indicating that plain paper is detected is transmitted from the detection unit 19 to the control device 18 to rotate the driving motor 27. When the driving motor 27 is rotated, the weight 21 is moved to a position close to the roller 25, as shown in FIG. 8. When the weight 21 is moved, an arm 12 is largely pivoted downward against the biasing force of the spring 14. The backup roller 7 is abutted against the intermediate transfer medium 6 with a strong force to urge the plain paper against the intermediate transfer medium 6 with a strong force.

Figure 9:
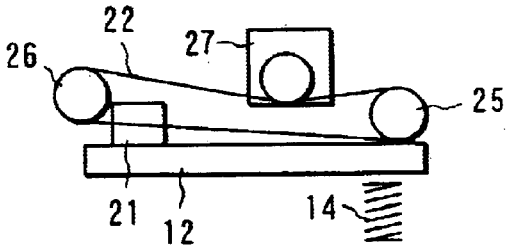
FIG. 9 is a view showing the operation in the paper non-passing mode.

When no paper is to be passed, information indicating that no paper is detected is transmitted from the detection unit 19 to the control device 18 to rotate the driving motor 27. When the driving motor 27 is rotated, as shown in FIG. 9, the weight 21 is moved to a position close to the roller 26. When the weight 21 is moved, then arm 12 is pivoted upward by the biasing force of the spring 14, and the backup roller 7 is separated from the intermediate transfer medium 6.

Figure 10:
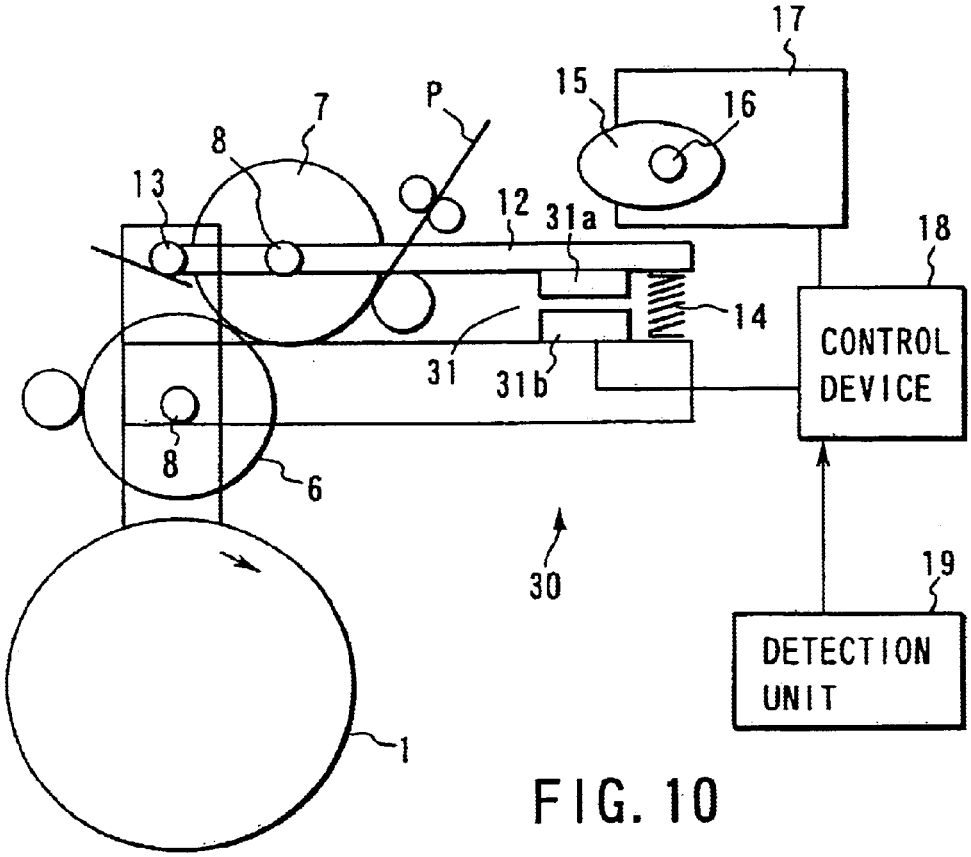
FIG. 10 is a view showing a third example of the arrangement of the changing device.

FIG. 10 is a view showing the arrangement of the changing device according to the second modification.

A changing device 30 according to the second modification is obtained by adding an electromagnet 31 to the structure shown in FIG. 4.

More specifically, the electromagnet 31 has upper and lower magnet pieces 31*a* and 31*b*. The upper magnet piece 31*a* is attached to the other end of the arm 12. The lower magnet piece 31*b* is stationarily provided to be separate from the upper magnet piece 31*a* to face it. The lower magnet piece 31*b* is connected to the control device 18, and the control device 18 is connected to the detection unit 19.

According to the third modification, the operations of passing no paper and passing art paper are similar to those shown in FIGS. 4 and 6. When plain paper is to be passed, in addition to the operation shown in FIG. 5, the control device 18 energizes the electromagnet 31. The electromagnet 31 is thus excited, and the upper magnet piece 31*a* is attracted by the lower magnet piece 31*b*. Hence, the arm 12 is firmly held so that it can reliably urge the plain paper against the intermediate transfer medium 6 with a strong force.

Figure 11:
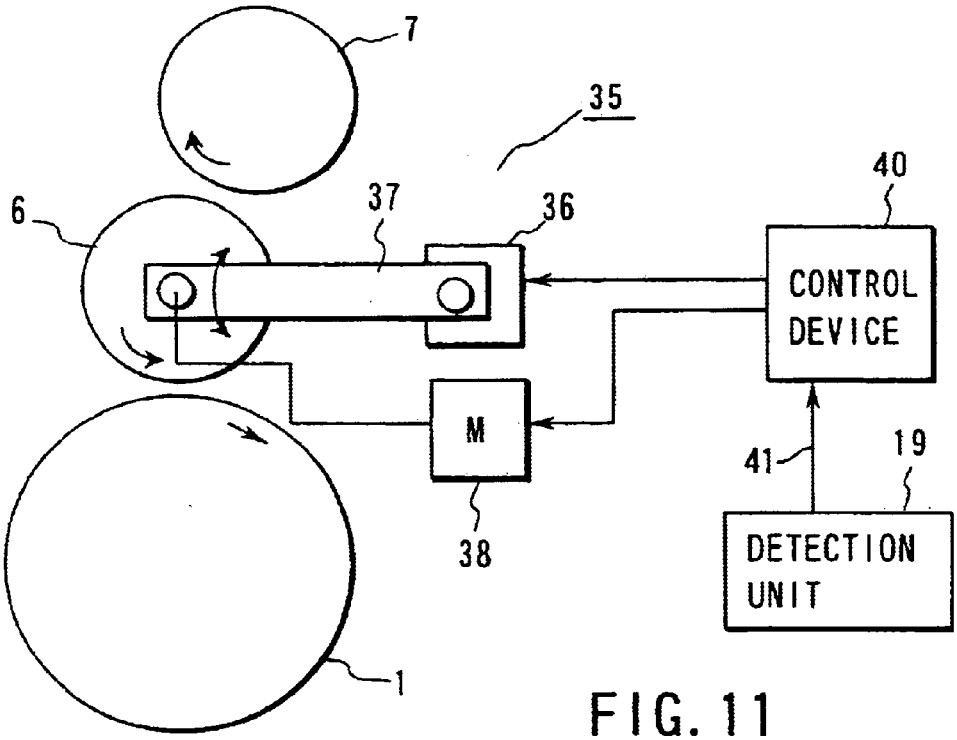
FIG. 11 is a view showing the arrangement of an image forming unit according to a second embodiment of the present invention.

FIG. 11 shows an image forming unit according to the second embodiment of the present invention.

The same portions as those shown in the first embodiment described above are denoted by the same reference numerals as in the first embodiment, and a detailed description thereof will be omitted.

According to the second embodiment, an intermediate transfer medium 6 is driven by a driving mechanism 35 to come into contact with and separate from a photosensitive body 1. The driving mechanism 35 is constituted by a driving unit 36 and a swing lever 37 which is swung by the driving unit 36. The intermediate transfer medium 6 is attached to the swing end of the swing lever 37. The intermediate transfer medium 6 is rotated by a variable-speed driving motor 38. The driving unit 36 and driving motor 38 are connected to a control device 40 through control circuits, and the control device 40 is connected to a detection unit 19 which detects the type of sheet through a signal line 41.

Figure 12:
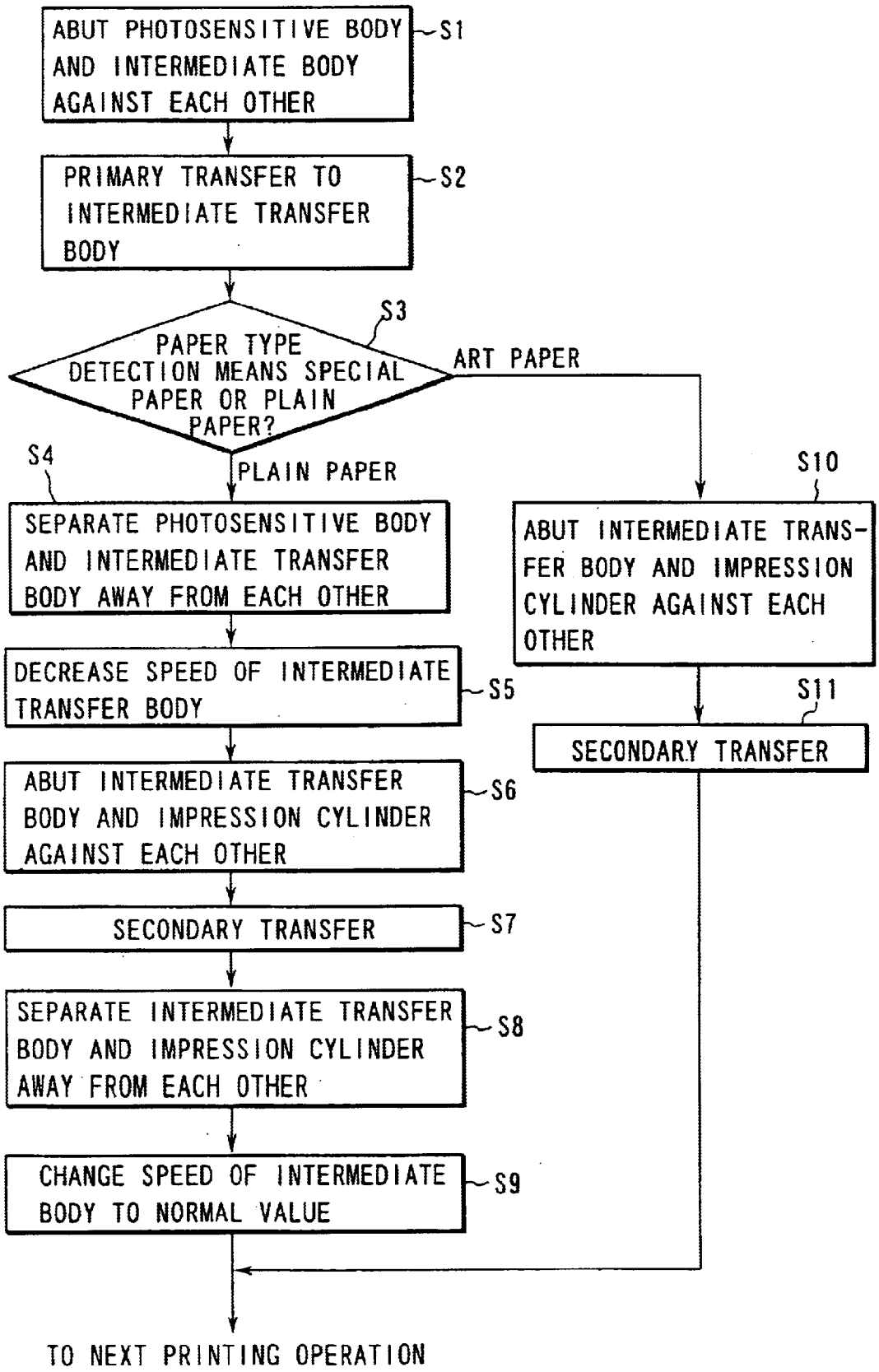
FIG. 12 is a flow chart showing the operation of the image forming unit shown in FIG. 11.

FIG. 12 is a flow chart showing the operation of the image forming unit.

When an image is to be formed, the driving unit 36 is operated to pivot the swing arm 37 downward, so that the intermediate transfer medium 6 abuts against the photosensitive body 1 (step S1). After this abutment, the toner image on the photosensitive body 1 is primarily transferred to the intermediate transfer medium 6 (step S2). The detection unit 19 detects a sheet to be passed and determines whether it is plain paper or art paper (step S3). If the sheet is plain paper, the driving unit 36 pivots the swing arm 37 upward to separate the intermediate transfer medium 6 from the photosensitive body 1 (step S4). Then, the driving motor 38 rotates the intermediate transfer medium 6 at a low speed (step S5). A backup roller 7 is abutted against the intermediate transfer medium 6 (step S6). Thus, the toner image on the intermediate transfer medium 6 is secondarily transferred to the backup roller 7 (step S7). After this transfer, the backup roller 7 is separated from the intermediate transfer medium 6 (step S8). Subsequently, the rotational speed of the intermediate transfer medium 6 is changed to a normal value (step S9), and the next printing operation is performed.

In step S3, if the type of sheet is art paper, the backup roller 7 is abutted against the intermediate transfer medium 6 (step S10). Hence, the toner image on the intermediate transfer medium 6 is secondarily transferred to the art paper (step S11). After this transfer, the next printing operation is performed.

Figure 13:
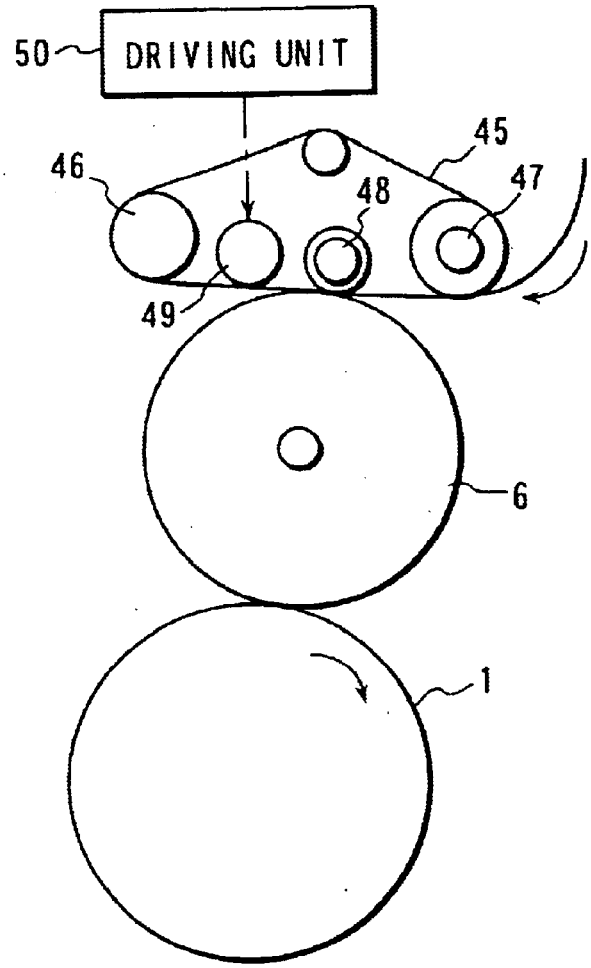
FIG. 13 is a view showing the arrangement of an image forming unit according to a third embodiment of the present invention.

FIG. 13 is a view showing the arrangement of an image forming unit according to the third embodiment of the present invention.

Portions identical to those described in the first embodiment described above are denoted by the same reference numerals as in the first embodiment, and a detailed description thereof will be omitted.

According to the third embodiment, a transfer belt 45 is provided above an intermediate transfer medium 6 to extend through a plurality of rollers 46 and 47. A backup roller 48 is pressed against the intermediate transfer medium 6 through the transfer belt 45. An auxiliary roller 49 is provided near the backup roller 48. The auxiliary roller 49 is vertically moved by a driving device 50 to move the intermediate transfer medium 6 to come close to and separate from the intermediate transfer medium 6.

Figure 14:
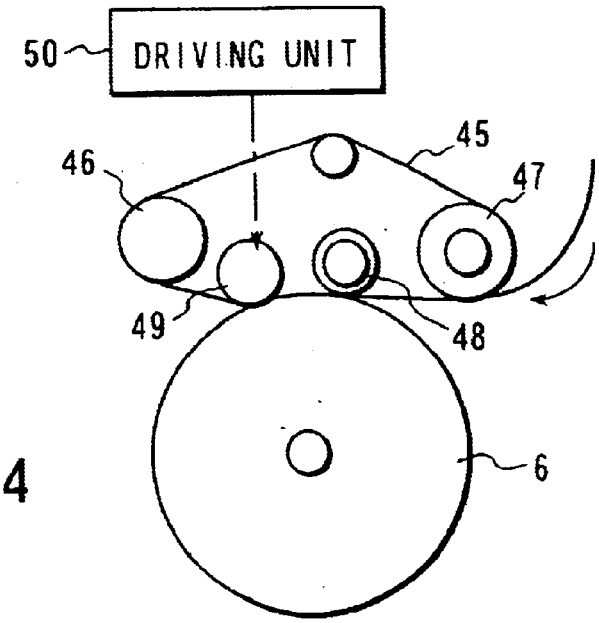
FIG. 14 is a view showing an image transfer operation when plain paper is to be passed.

According to the third embodiment, the transfer time is prolonged by increasing the transfer nip width for secondary transfer. More specifically, the third embodiment exemplifies a method of conveying the sheet by attracting it with the transfer belt 45. For plain paper, as shown in FIG. 14, the auxiliary roller 49 is pressed against the intermediate transfer medium 6 to widen the transfer nip, thereby prolonging the transfer time. The transfer nip width is usually about 1 mm to 10 mm, but can be increased to about 20 mm to 100 mm by further pressing the auxiliary roller 49 against the intermediate transfer medium 6.

When the transfer time is prolonged, a toner image can be transferred to even paper with a rough surface. However, since the pressure dependency is high, a sufficient effect cannot be obtained unless the transfer time is prolonged very long. When the transfer nip is excessively widened, image disturbance tends to be caused by fine fluctuations in speed. Hence, for art paper or the like which requires only a short transfer time, the nip width should be minimized.

According to this embodiment, the transfer nip is largely widened by the auxiliary roller 49 only for plain paper with which the transfer efficiency is the first priority.

TABLE 1

Result of Service Life Test (Number of Sheets Passed Until Intermediate Transfer Body is Damaged by Paper Jamming or the Like to Adversely Affect Image and Until Transfer Efficiency Decreases to 70% or Less)

| | Paper Passing Ratio | First Time | Second Time | Third Time |
|---|---|---|---|---|
| Present invention not applied (Load: 60 kgf) | art paper | 10k sheets | 9.5k sheets | 15k sheets |
| | art paper 1:1 plain paper | 12k sheets | 13k sheets | 8k sheets |
| Load of 10 kgf applied for art paper | art paper | 60k sheets | 40k sheets | 50k sheets |
| | plain paper | 11k sheets | 9k sheets | 9k sheets |
| Load of 60 kgf applied for plain paper | art paper 1:1 plain paper | 20k sheets | 15k sheets | 25k sheets |
| | art paper 4:1 plain paper | 50k sheets | 50k sheets | 35k sheets |
| Transfer speed decreased to 1/5 plain paper | art paper 1:1 plain paper | 25k sheets | 30k sheets | 30k sheets |
| | art paper 4:1 plain paper | 40k sheets | 50k sheets | 40k sheets |

Table 1 shows the comparison results of the service life of the intermediate transfer medium 6 among cases wherein the present invention described above is and is not employed.

When printing was performed with only plain paper from the beginning to the end, no effect was obtained at all with the present invention. An obvious difference was observed in the service life of the intermediate transfer medium 6 between a case wherein plain paper and art paper in the same amount are passed and a case wherein art paper and plain paper were passed at a ratio of 4:1.

More specifically, the service life of the intermediate transfer medium 6 is prolonged when a pressure more than necessary is not applied. The type of the paper used may be detected by various methods. The most simple method is manual input of the data representing the type of the paper. The surface roughness of the paper need not be measure. It is sufficient for the user to input data showing whether the paper is of a special type or the ordinary type.

When toner with very fine particles such as liquid toner is to be transferred to a sheet with a rough surface such as plain paper, the lower the image density of the toner layer, i.e., the smaller the thickness of the toner layer, the lower the transfer efficiency. This is because a thick toner layer is formed as a film and is transferred, whereas a thin toner layer with a thickness of less than 0.4 $\mu$m cannot be formed as a film well. Hence, a thinner toner layer which is more difficult to be formed as a film leads to a lower transfer efficiency.

Figure 15:
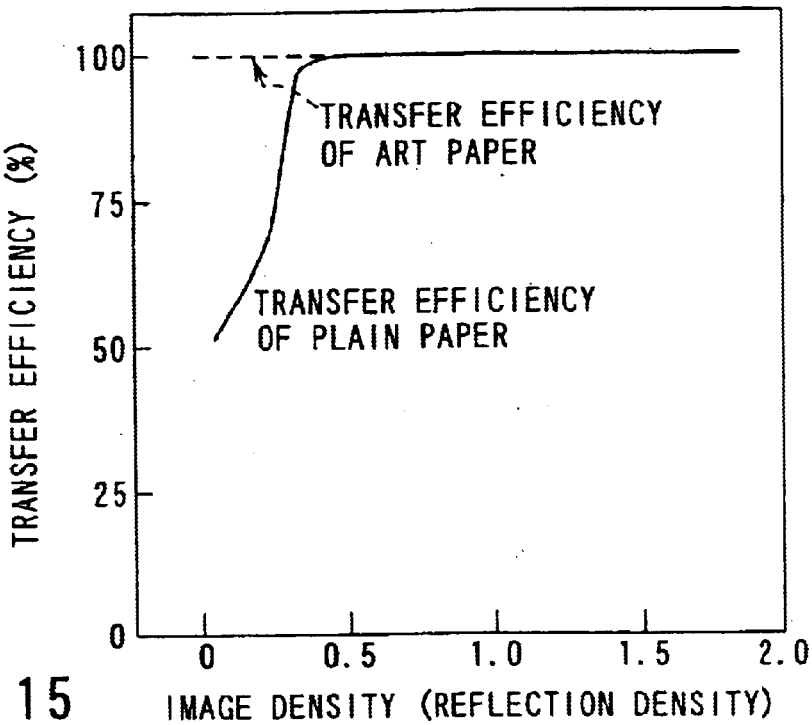
FIG. 15 is a graph showing the transfer efficiency of art paper and plain paper in comparison.

FIG. 15 is a graph showing the relationship between the image density and transfer efficiency.

When the image density becomes 0.5 or less, the transfer efficiency obviously decreases in plain paper. At this time, the thickness of the toner layer was approximately 0.2 $\mu$m to 0.4 $\mu$m when observed with an SEM.

According to the present invention, a table of the transfer efficiency with respect to the image density is stored in a CPU or the like in advance. When paper with a rough surface is to be passed, the image density is increased to be higher than that in a case wherein paper such as art paper with a smooth surface is to be passed. Particularly, exposure is controlled to be corrected so a low-density portion will not be formed in the toner image.

Figure 16:
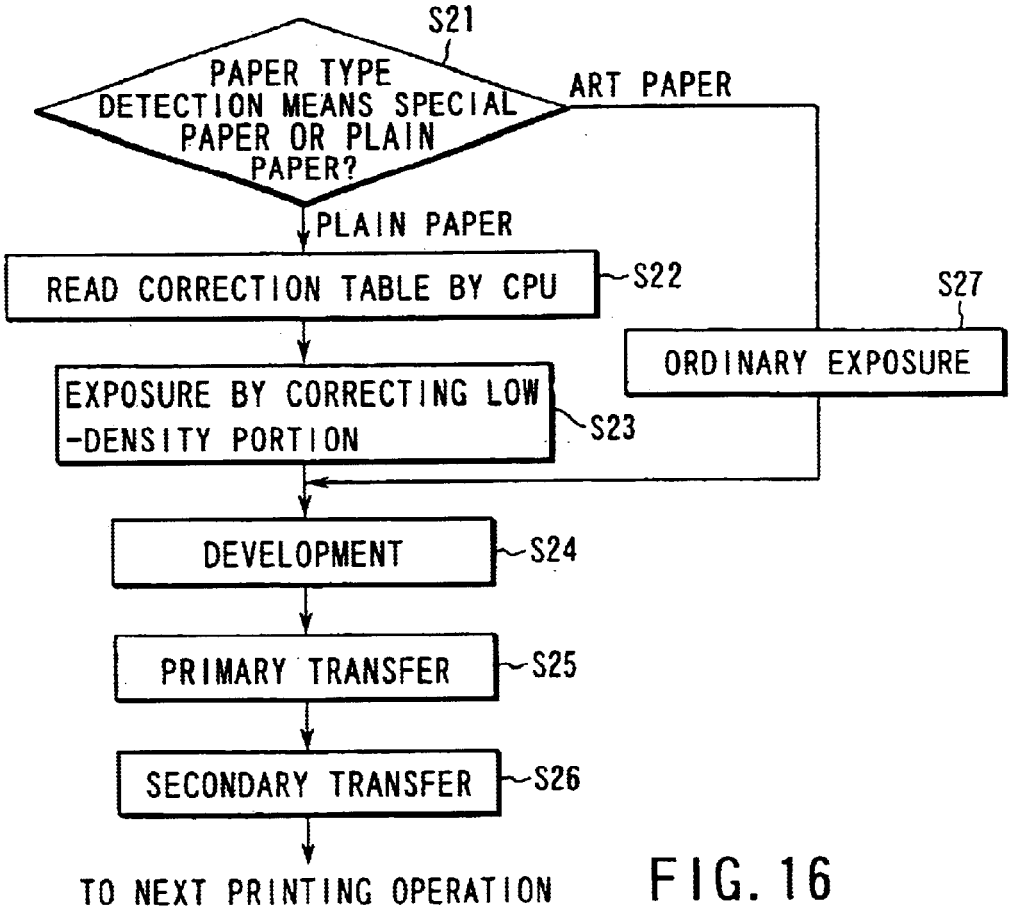
FIG. 16 is a flow chart showing an image forming operation for art paper and plain paper.

FIG. 16 is a flow chart showing practical operation.

In passing a sheet, the detection unit 19 detects the type of sheet and determines whether the sheet is plain paper or special paper (step S21). If the sheet is plain paper, the control device 18 reads a correction table (step S22). The photosensitive body 1 is corrected and exposed to form a latent image. More specifically, the photosensitive body 1 is exposed after it is corrected such that, when the latent image is developed to form a toner image, a low-density portion will not be formed in the toner image (step S23). After the latent image is formed in this manner, the developing solution is supplied to develop it (step S24). This toner image is primarily transferred from the photosensitive drum 1 to the intermediate transfer medium 6 (step S25). Subsequently, the toner image is secondarily transferred from the intermediate transfer medium 6 to the sheet P (step S26).

In step S1, if the sheet is art paper, ordinary exposure is performed (step S27), and operations from step S24 are performed.

As described above, according to the present invention, in the electrophotographing apparatus for transferring a liquid toner image to a sheet through the intermediate transfer medium 6, the pressure or transfer time during secondary transfer is controlled in accordance with the type of sheet to be used. Therefore, the service life of expendables such as the intermediate transfer medium 6 can be prolonged, and good transfer is enabled.

If the sheet has a rough surface, the transfer efficiency at the low-density image portion decreases. However, the electrostatic latent image is formed after correcting exposure in advance so as not to form a low-density image portion in the toner image, and is developed. Therefore, an image with a high image quality can be obtained in the same manner as in a case wherein the sheet has a smooth surface.

The embodiments described above show that according to the present invention, the pressure of secondary transfer, i.e., the abutting force between the intermediate transfer medium 6 and backup roller 7, is changed in accordance with the type of sheet, so that both the service life of the intermediate transfer medium 6 and the good transfer performance of the plain paper are satisfactory.

When the load during secondary transfer is increased, the amount of deformation of the intermediate transfer medium 6 increases, and the image is undesirably elongated on the sheet, thus posing another problem.

In order to prevent this, according to the present invention, when the load in secondary transfer is to be increased in printing on plain paper and the like, the load in primary transfer from the photosensitive drum 1 to the intermediate transfer medium 6 is also increased. As a result, the elongation and shrinkage in image in primary and secondary transfer operations cancel each other, so that elongation and shrinkage in the final image are eliminated.

More specifically, in secondary transfer of the toner image from the intermediate transfer medium 6 to the sheet, the larger the load, the longer the image becomes. In primary transfer of the toner from the photosensitive body 1 to the intermediate transfer medium 6, the larger the load, the shorter the transferred image becomes.

Accordingly, when the load in secondary transfer is to be increased for printing on plain paper or the like, if the load in primary transfer is also increased simultaneously, elongation and shrinkage in the final image can be eliminated.

Figure 17:
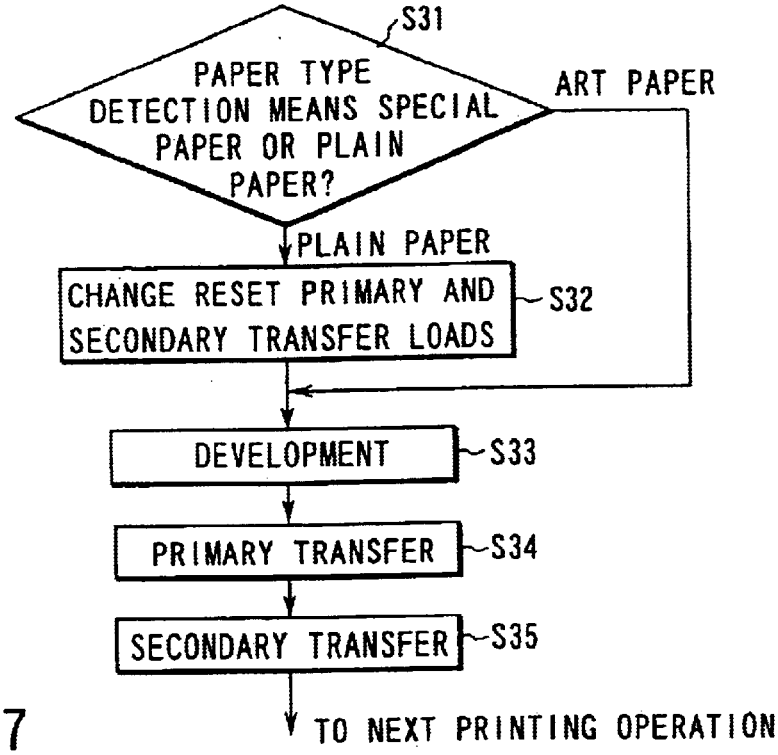
FIG. 17 is a flow chart showing another image forming operation according to the present invention.

FIG. 17 is a flow chart showing practical operation.

When a sheet is being passed, the detection unit 19 detects it and determines whether it is plain paper or art paper (step S31). When the sheet is plain paper, the abutting force between the intermediate transfer medium 6 and backup roller 7 is increased, and the abutting force between the intermediate transfer medium 6 and photosensitive body 1 is also increased. More specifically, the loads in primary and secondary transfer operations are appropriately changed (step S32). After that, the latent image on the photosensitive drum 1 is developed to form a toner image (step S33), and the toner image is primarily transferred from the photosensitive drum 1 onto the intermediate transfer medium 6 (step S34). After that, the toner image transferred onto the intermediate transfer medium 6 is secondarily transferred to the sheet P (step S35). In step S31, if the sheet is art paper, operations from step S33 are performed.

In this manner, the image on the intermediate transfer medium 6 can be shortened without changing the length of the toner image on the photosensitive drum 1. The image is elongated by the large load in secondary transfer, and finally transferred to the sheet P as an image with a right length.

According to the present invention, when the transfer load is set large for performing printing on plain paper, the length of the image may be adjusted by setting the rotational speed of the photosensitive drum 1 to slightly low.

More specifically, when the rotational speed of the photosensitive drum 1 is set to slightly low, the toner image is formed on the photosensitive drum 1 to be slightly short. This toner image is primarily transferred to the intermediate transfer medium 6. When a large load is applied in secondary transfer, the slightly short toner image is elongated, and finally transferred on the sheet as an image with a right length.

In this case, the rotational speed of the intermediate transfer medium 6 must also be decreased in accordance with the rotational speed of the photosensitive drum 1. The sheet convey speed must also be decreased in accordance with the rotational speed of the intermediate transfer medium 6.

The length of the image can be adjusted by adjusting the convey speeds of the photosensitive drum 1, intermediate transfer medium 6, and sheet P to have different speeds. When the photosensitive drum 1, intermediate transfer medium 6, and backup roller 7 are abutted against each other with large pressures, as in the present invention, it is difficult to drive them while maintaining fine speed differences among them. According to the present invention, in primary transfer, transfer can be performed with a comparatively small load. Hence, if a speed difference is to be provided, it is preferably done so in primary transfer, or second transfer if the sheet is art paper.

Figure 18:
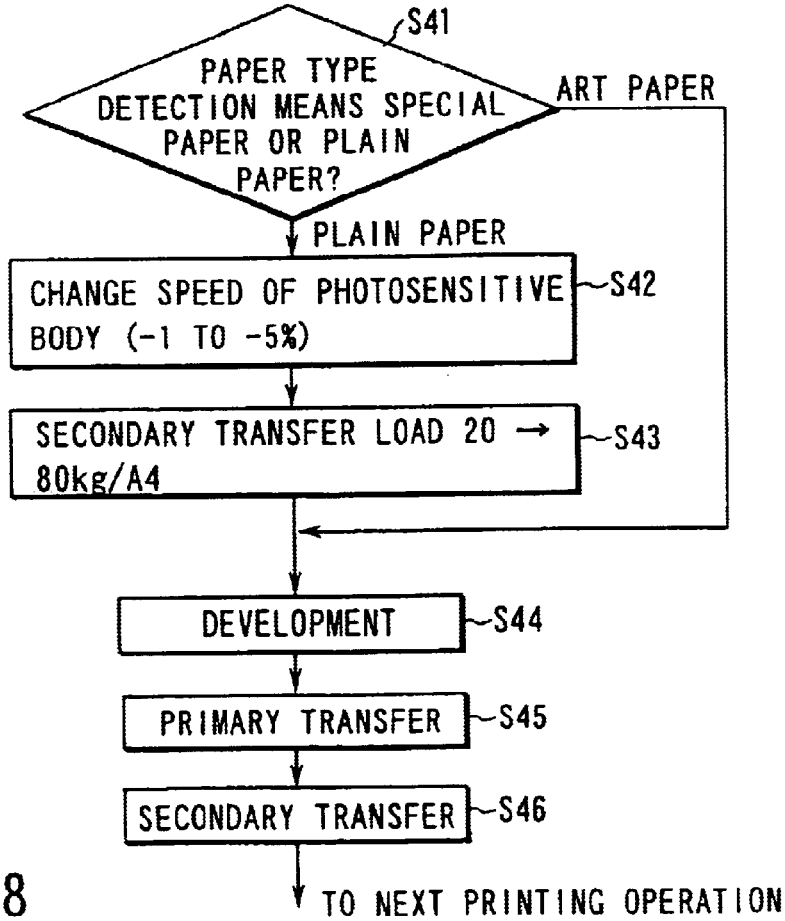
FIG. 18 is a flow chart showing another image forming operation according to the present invention.

FIG. 18 is a flow chart showing practical operation.

In passing a sheet, the detection unit 19 detects it and determines whether it is plain paper or art paper (step S41). If the sheet is plain paper, the rotational speed of the photosensitive body 1 is decreased by 1% to 5% (step S42). After that, the secondary transfer load is increased from 20 kg/A4 to 80 kg/A4 (step S43). Subsequently, the latent image on the photosensitive drum 1 is developed with the liquid developer (step S44). After development, the developer image on the photosensitive drum 1 is primarily transferred to the intermediate transfer medium 6 (step S45). Subsequently, the developer image is secondarily transferred to the sheet by rotation of the intermediate transfer medium 6 (step S46).

In step 41, if the sheet is art paper, operations from step 44 described above are performed.

According to the present invention, when a large secondary transfer load is set, the rotational speed of the intermediate transfer medium 6 may be decreased to be lower than that in an ordinary case.

More specifically, when a large secondary transfer load is set to cope with plain paper, the intermediate transfer medium 1 is rotated at a speed lower than that of the photosensitive drum 1 by 1% to 5%.

Hence, an image is transferred short onto the intermediate transfer medium 6. This shrinkage in image is canceled when the transferred short image is elongated as a load is applied to it in secondary transfer. The shrinkage-canceled image is transferred to the sheet.

In this case, separate driving units are required for the photosensitive body 1 and intermediate transfer medium 6. The backup roller 7 may be rotatably driven at substantially the same speed as that of the intermediate transfer medium 6, or may be driven by the intermediate transfer medium 6.

Figure 19:
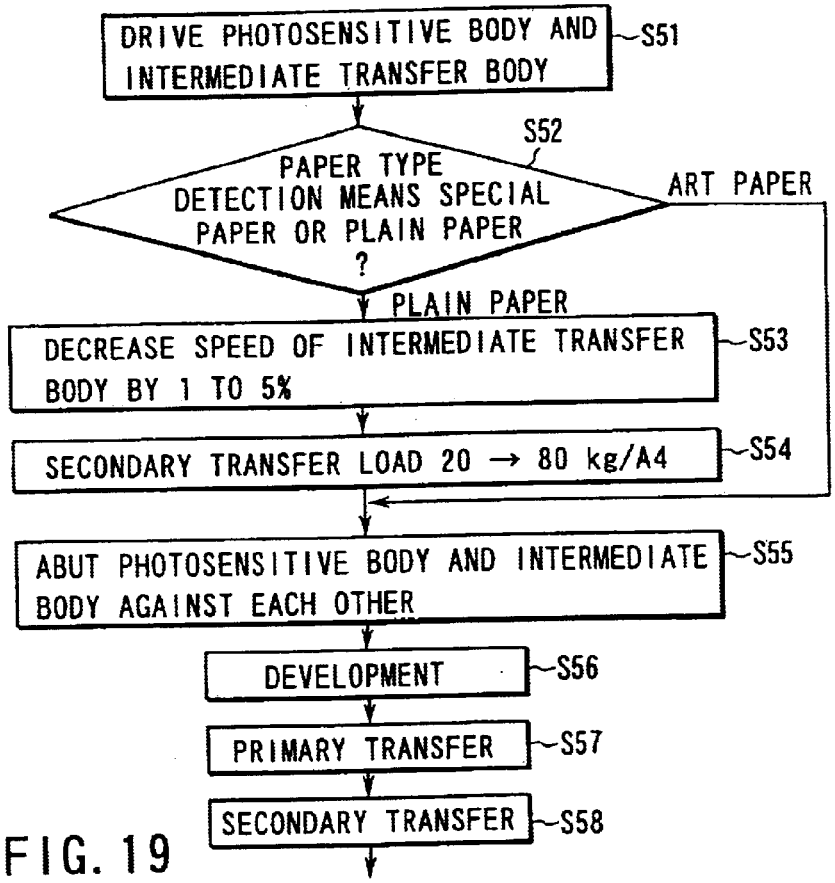
FIG. 19 is a flow chart showing another image forming operation according to the present invention.

FIG. 19 is a flow chart showing practical operation.

The photosensitive drum 1 and intermediate transfer medium 6 are rotatably driven (step S51). In passing a sheet, the detection unit 19 detects it and determines whether it is plain paper or art paper (step S52). If the sheet is plain paper, the rotational speed of the photosensitive drum 1 is decreased by 1% to 5% (step S53). Subsequently, the secondary transfer load is increased from 20 kg/A4 to 80 kg/A4 (step S54). After that, the intermediate transfer medium 6 is abutted against the photosensitive body 1 (step S55). After this abutment, the latent image on the photosensitive body 1 is developed with a liquid developer (step S56). After development, the developer image on the photosensitive body 1 is primarily transferred on the intermediate transfer medium 6 (step S57). Subsequently, the developer image is secondarily transferred to the sheet by rotation of the intermediate transfer medium 6 (step S58).

In step 52, if the sheet is art paper, operations from step 55 described above are performed.

According to the present invention, as shown in FIG. 18, when a large load in secondary transfer is set and a low rotational speed is set for the photosensitive drum 1 so as not to elongate the final image, if a low secondary transfer load is set in the art paper mode or the like, the sheet may be driven faster than the intermediate transfer medium 6.

Therefore, even if a low load is set in secondary transfer, a final image free from elongation or shrinkage can be consequently obtained.

In this case, note that all the photosensitive body 1, intermediate transfer medium 6, and backup roller 7 must be driven.

Figure 20:
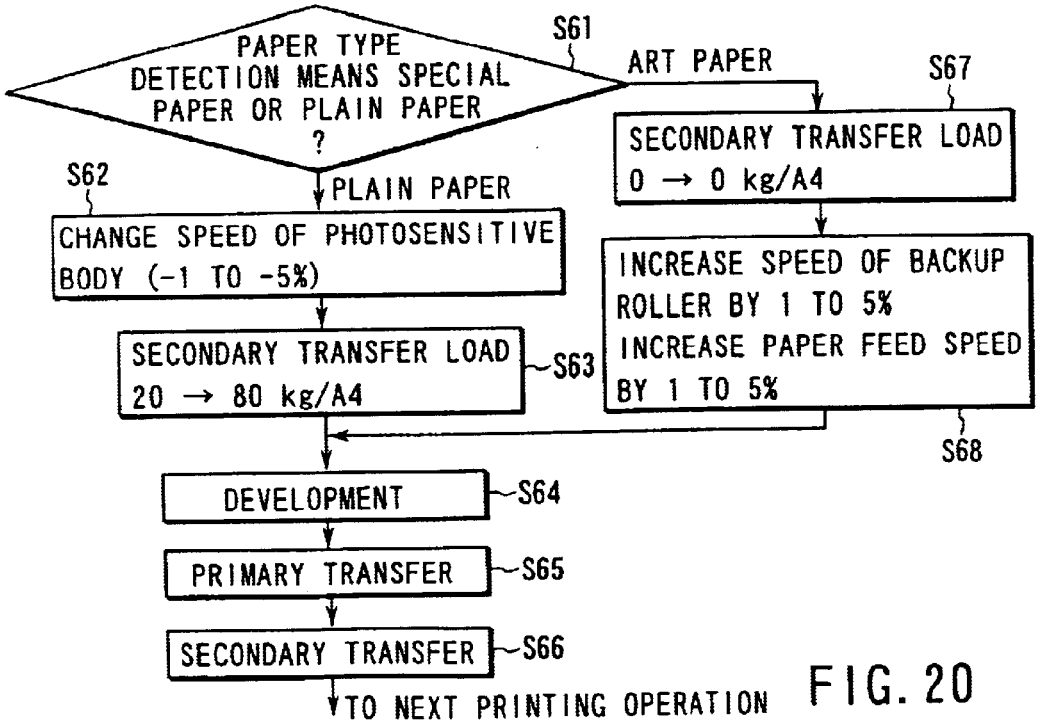
FIG. 20 is a flow chart showing another image forming operation according to the present invention.

FIG. 20 shows a flow chart showing practical operation.

In passing a sheet, the detection unit 19 detects it and determines whether it is plain paper or art paper (step S61). If the sheet is plain paper, the rotational speed of the photosensitive body 1 is decreased by 1% to 5% (step S62).

After that, the secondary transfer load is increased from 20 kg/A4 to 80 kg/A4 (step S63). Subsequently, the latent image on the photosensitive drum 1 is developed with the liquid developer (step S64). After development, the developer image on the photosensitive body 1 is primarily transferred to the intermediate transfer medium 6 (step S65). Subsequently, the developer image is secondarily transferred to the sheet by rotation of the intermediate transfer medium 6 (step S66).

When the rotational speed of the photosensitive drum 1 is decreased by 1% to 5% and the secondary transfer load is increased from 20 kg/A4 to 80 kg/A4, if it is determined in step S61 that the sheet being passed is art paper, the secondary transfer load is decreased from 80 kg/A4 to 20 kg/A4 (step S67), and the rotational speed of the backup roller 7 is increased by 1% to 5%, so that the paper feed speed is increased by 1% to 5% (step S68). After that, operations from step S63 described above are performed.

Experimental results will be described.

In experiments, the secondary transfer load was set to 10 kg/A4 to 20 kg/A4 for art paper and 80 kg/A4 to 100 kg/A4 for plain paper. When the present invention was not employed, the length of the image on the plain paper undesirably increased by 3% or more.

In the experiment concerning FIG. 17, the primary transfer load, which is usually set to about 20 kg/A4, was increased to about 100 kg/A4 only when plain paper was to be passed. An elongation of about 3% finally became substantially 0.

A change unit which changes the pressure contact force between the photosensitive drum 1 and intermediate transfer medium 6 in primary transfer can operate on the same principle as that for the changing device 11 which changes the abutting force between the intermediate transfer medium 6 and backup roller 7 in secondary transfer shown in the first embodiment described above. Therefore, this change unit will not be described particularly in detail.

In the experiment concerning FIG. 18, when the rotational speed of the photosensitive drum 1 was decreased by about 3% only when printing plain paper, a good image free from elongation or shrinkage was obtained on the sheet. In this experiment, since the intermediate transfer medium 6 is driven by the photosensitive drum 1, a large speed difference does not occur between them, and the surface of the intermediate transfer medium 6 will not be damaged.

Since the speed of the photosensitive drum 1 was changed only by about 1% to 5%, it did not adversely affect other processes substantially at all, and no undesirable effects were caused by this.

In the experiment concerning FIG. 19, in the plain paper mode, when the rotational speed of the intermediate transfer medium 6 was decreased by 3%, an elongation or shrinkage on the image was eliminated. The primary transfer load was set to 10 kg/A4. This may help maintain the speed difference stably.

In the experiment concerning FIG. 20, the speed of the photosensitive body was changed from the initial value to the value shown in FIG. 18, and the secondary transfer load was decreased to 10 kg/A4 when art paper was to be passed. In this state, the image was shortened by about 3.5%. When the speed of the sheet was increased by 3% to 4%, shrinkage in the image disappeared, and a good image was obtained.

As has been described above, according to the present invention, even when the load applied by the intermediate transfer medium 6 to the sheet in secondary transfer of the toner image is changed, an elongation or shrinkage in the final image can be avoided, and a good image can be obtained.

Figure 21:
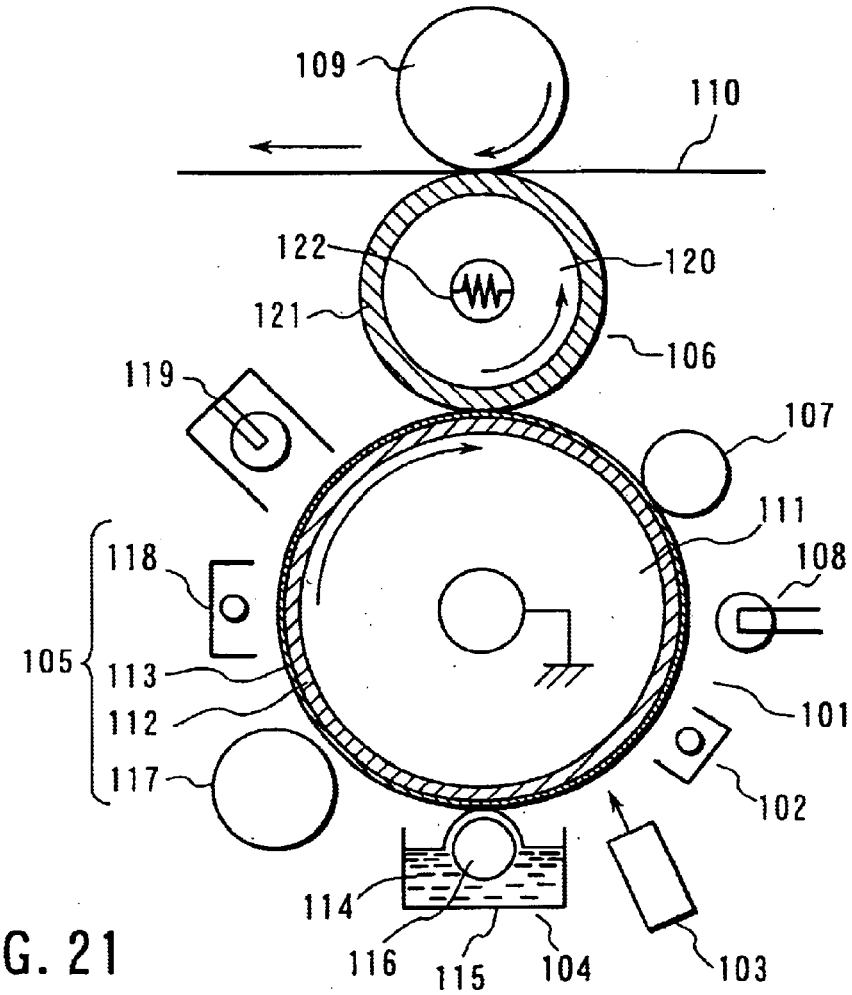
FIG. 21 shows the structure of an image forming apparatus according to a fourth embodiment of the present invention.

FIG. 21 shows an image forming apparatus according to a fourth embodiment of the present invention.

This image forming apparatus includes a photosensitive body 101 serving as an electrostatic latent image carrying body, a charger 102 for uniformly charging the surface of the photosensitive body 101, and an optical unit 103 serving as a latent image forming device for radiating light to the charged surface in accordance with an image signal and thus forming an electrostatic latent image. The image forming apparatus also includes a developing unit 104, which applies liquid toner to the surface of photosensitive body 101 carrying the electrostatic latent image and thus forms a toner image of liquid developer on the surface of photosensitive body 101, a condensing unit 105 for condensing the formed toner image, and an intermediate transfer medium 106 for transferring the condensed toner image. The image forming apparatus further includes cleaning means 107 for recovering residual toner on the surface of the photosensitive body 101, and a charge eraser 108 for erasing the charge on the surface of photosensitive body 101.

A press roller 109 for applying pressure on a recording medium is provided on top of the intermediate transfer medium 106. The recording medium 110 is conveyed by a convey mechanism (not shown) and passed between the intermediate transfer medium 106 and pressing roller 109.

The photosensitive body 101 comprises a metallic drum 111 of aluminum, etc. A photosensitive layer 112 about 10 $\mu$m to about 40 $\mu$m thick is formed on the surface of the metallic drum 111. The surface of the photosensitive layer 112 is coated with a release layer 113 about 1 $\mu$m to about 5 $\mu$m thick, which is formed of a fluororesin or a silicone resin. A belt, etc. may be substituted for the metallic drum 111 of photosensitive body 101.

The developing unit 104 comprises a toner container 115 for containing liquid toner 114, and a developing roller 116 for supplying the liquid toner 114 to the release layer 113 on the photosensitive body 101. A belt may be substituted for the developing roller 116.

In an instance of the liquid toner 114, toner particles with a gain size of about 2 $\mu$m or less, which contain pigment components, are dispersed in a carrier liquid such as an insulative hydrocarbon solvent. Additionally, the liquid toner disclosed in U.S. Pat. No. 5,407,771 may be used.

In the present embodiment, toner particles are positively charged in the solvent. A development potential is applied to the liquid toner so that toner particles may move in the carrier liquid, thereby developing the electrostatic latent image into a visible image.

The condensing unit 105 comprises a squeeze unit 117, a fixing unit 118 for a toner image, and a solvent removing unit 119. The squeeze unit 117 removes fogging of a toner image formed by the developing unit 104 and restricts the thickness of the liquid toner. The fixing unit 118 increases adhesion of the squeezed toner image on the surface of the release layer 113, thus preventing flow of the image. The solvent removing unit 119 removes the solvent of the fixed toner image.

The solvent removing unit 119 may be a porous roller that is put in contact with the photosensitive body 101 and is capable of absorbing the solvent. The porous roller has electrical conductivity. A urethane sponge roller with a pore size of about 30 $\mu$m or less may be used for the porous roller, and with application of a voltage of the same polarity as the toner particles, toner contamination can be prevented.

If the urethane sponge roller is provided with an auxiliary roller for squeezing out the absorbed solvent, it can have a stable solvent removing performance over a longer period of time.

Additionally, in this embodiment, a solvent removing unit with a higher efficiency can be realized in combination with an air blower (not shown).

Examples of the squeeze roller of squeezing unit 117 and the roller of solvent removing unit 119 are disclosed, for instance, in U.S. Pat. No. 5,028,964 as various types of rigidizing rollers, in U.S. Pat. No. 5,255,058 as a reverse roller of a background cleaning station, and in U.S. Pat. No. 5,276,492 as typically charged rotating rollers and rigidizing rollers. The related descriptions in these patents are incorporated as part of the description of the present embodiment.

The intermediate transfer medium 106 comprises a metallic roller 120 and an elastic layer 121 formed on the surface of the roller 120 with a thickness of about 1 mm or less. The elastic layer 121 is formed of urethane rubber, fluoro-rubber, epichlorhydrin rubber, silicone rubber, etc. A heater 122 comprising a halogen lamp, etc. is provided inside the metallic roller 120.

The intermediate transfer medium 106 may comprise a belt in lieu of the metallic roller 120, and a plurality of support members that support the belt at a contact point with the photosensitive body 101 and a contact point with the press roller 109. In this case, an image at the contact point with the photosensitive body 101 or an image at the contact point with the press roller 109 may be heated.

Various structures can be adopted for heating the image on the belt. For example, a heater is provided inside the support member at the contact point with the press roller 109, or a heater is provided to face the belt surface on the upstream side of the contact point with the press roller 109 in the rotational direction of the belt.

Similarly, in order to heat the image at the contact point with the photosensitive body 101, a heater may be provided inside the support member at the contact point with the photosensitive body 101. Alternatively, a heater may be provided to face the belt surface on the upstream side of the contact point with the photosensitive body 109 in the rotational direction of the belt.

The intermediate transfer element disclosed in U.S. Pat. No. 5,636,349 may be substituted for the metallic roller 120 of intermediate transfer medium 106 and the heating means therefor. The related description in this patent is incorporated as part of the description of the present embodiment.

The press roller 109 should preferably be a metallic roller, or a metallic roller with an elastic surface layer. In addition, a heater should preferably be provided inside the metallic roller to heat the whole roller at about 60–180° C. In this embodiment, the metallic roller is heated at about 100° C.

The photosensitive body 101, intermediate transfer medium 106 and press roller 109 are independently rotated by individual driving mechanisms (not shown). Alternatively, the photosensitive body 101, intermediate transfer medium 106 and press roller 109 may be rotated by a single driving source, with their respective rotational speeds being adjusted by adjusting mechanisms such as gears.

The image forming process of the above-described image forming apparatus will now be described.

The surface of the release layer 113 of photosensitive body 101 is uniformly charged by the charger 102 at about +800V. The optical unit 103 illuminates image information light on the charged surface of release layer 113 and lowers the potential to about +100V, thus forming an electrostatic latent image. The developing unit 104 is disposed with a gap of about 100 $\mu$m between the developing roller 116 and the release layer 113. This gap is filled with liquid toner 114 supplied by the developing roller 116. A voltage of about +600 is applied by a power supply (not shown) to the surface of the developing roller 116. Accordingly, when the electrostatic latent image passes through the region where the photosensitive body 101 and developing roller 116 are opposed and put in contact via the liquid toner 114, an electric field acting from the developing roller 116 toward the photosensitive body 101 is produced at the area with the electrostatic latent image, and an electric field acting from the photosensitive body 101 toward the developing roller 116 is produced at the area without the electrostatic latent image. Thus, the positively charged toner particles in the liquid toner 114 adhere to only the region with the latent image.

As a result, a toner image is formed on the area with the latent image on the release layer 113 of photosensitive body 1. The toner image is brought to the squeeze unit 117 by the rotation of the photosensitive body 1. At this time, the potential of the toner image has risen up to about +300V. This development is based on an inversion development method, but it may be based on a normal development method.

The metallic roller of squeeze unit 117 is arranged with a gap of about 50 $\mu$m from the surface of the release layer 113 of photosensitive body 1, and a voltage of about +600V is applied to the metallic roller. When the liquid toner image approaches the squeeze means 117, a strong electric field acting from the surface of release layer 113 toward the metallic roller is produced. In particular, a stronger electric field is produced at the area without the image than at the area with the image. Thus, charged toner particles floating in the non-image area are recovered. At the same time, the thickness of the toner image is restricted and decreased.

The toner image fixing unit 119 has the same charging means as the charger 102, thereby charging the toner image at a surface potential of about +800V. This surface charge produces an electric field acting from the surface of the toner image toward the metallic drum 111 within the photosensitive body 101. Thus, the toner particles in the toner image move closer to the surface of the release layer 113, and more firmly fixed due to an increased mirror image power acting with the metallic drum 111. Then, in the solvent removing unit 119, the toner image is condensed at a solid component concentration of 60% or more, and the non-image area is completely dried.

The toner image is condensed through the squeeze unit 117, fixing unit 118 and solvent removing unit 119. That is, about 40% or more of the solvent is removed from the toner image that has just been developed, and thus the toner image is condensed. The solvent removing unit 119 may be provided with air blow means, if necessary, which accelerates removal of the carrier liquid.

The condensed toner image is conveyed to the region where the photosensitive body 101 and intermediate transfer medium 106 are put in contact. In this region, a pressure, which is equivalent to a line-pressure of about 0.1 kg/cm to 20 kg/cm, is applied. The intermediate transfer medium 106 is heated by the heater 122 provided therein up to a glass transition point of toner particles or above, e.g. about 100° C. The heating in this step aims at facilitating secondary transfer (transfer to a recording medium).

It is possible to control the surface temperature of the photosensitive body 101 such that it is kept below the glass transition point of toner particles when the body 101 is put in contact with the heated intermediate transfer medium 106, thus preventing the adhesive force of toner particles to the photosensitive body 101 from increasing. In this embodiment, the surface temperature of the photosensitive body 101 at the time of primary transfer is controlled and kept below 45° C. by a cooling device (not shown) provided in the photosensitive body 101. Preferably, a belt-shaped intermediate transfer medium is used, and it is sufficiently heated at the time of secondary transfer alone and is radiated and cooled below the glass transition point of toner particles at the time of primary transfer.

Figure 22:
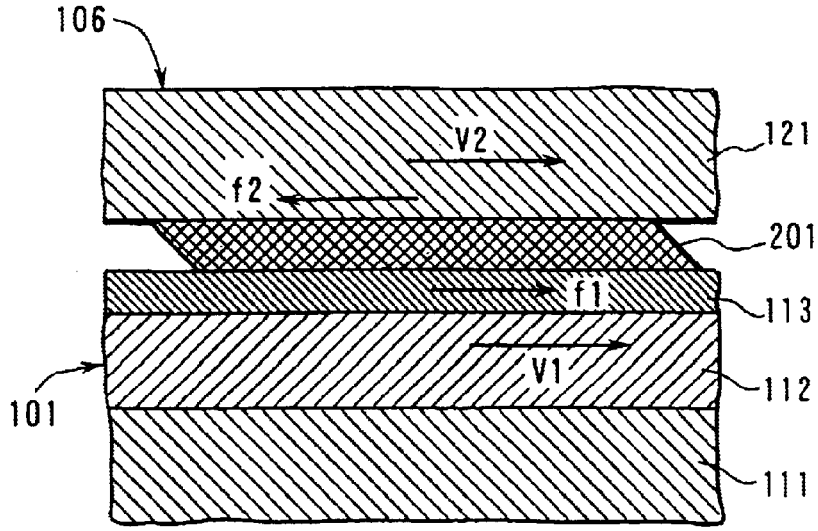
FIG. 22 illustrates a shearing stress acting while the toner image is being transferred to the intermediate transfer medium.

FIG. 22 is an enlarged cross-sectional view of the region where the photosensitive body 101 and intermediate transfer medium 106 are put in contact. A surface velocity v1 of the photosensitive body 101 is higher than a surface velocity v2 of the intermediate transfer medium 106. By virtue of a difference in velocity, a force f1 in the same direction as the direction of movement of photosensitive drum 101 acts at the interface between the toner image 201 and release layer 113.

On the other hand, a force f2 in a direction opposite to the direction of movement of photosensitive body 101 acts at the interface between the toner image 201 and elastic layer 121. Thus, a shearing stress acts in the toner image 201. The shearing stress decreases the adhesive force of the toner image 201 on the surface of the release layer 113, enabling the toner image 201 from being easily released from the surface of release layer 113.

The shearing stress is caused if the velocities v1 and v2 are made different. The inventors confirmed by experiments that the releasability of the toner image 201 was remarkably high when v1>v2. The velocity ratio v2/v1 may be set at about 0.8 to 0.9, or about 0.9 to 0.95, so as to cause a sufficient shearing stress in the toner image 201 and to prevent disturbance of the image.

In FIG. 21, if the photosensitive body 101 further rotates, residual toner, which has been left on the release layer 113 without transfer, is removed by the cleaning means 107. In addition, the residual charge is erased by the charge erase means 108.

On the other hand, the intermediate transfer medium 106, on which the toner image has been transferred, rotates in the direction of the arrow in FIG. 21. The toner image is conveyed to the region where the toner image is put in contact with the recording medium 110 pressed by the press roller 109. At this time, a pressure, which is equivalent to a line-pressure of about 0.2 kg/cm to about 20 kg/cm, acts on the toner image.

Figure 23:
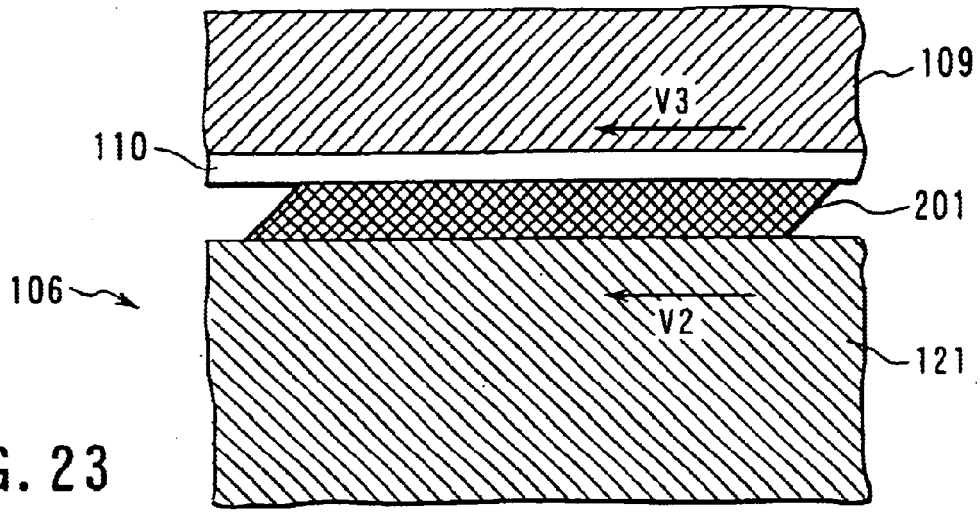
FIG. 23 illustrates a shearing stress acting while the toner image is being transferred to the paper.

FIG. 23 is an enlarged view of the region where the intermediate transfer medium 106 contacts the press roller 109 via the recording medium 110. A surface velocity v3 of the press roller 109 is set to be lower than the surface velocity v2 of intermediate transfer medium 106. If the velocity of the recording medium 110 is set at v3 by a friction force acting at the interface between the press roller 109 and recording medium 110, opposite-directional forces acting in the tangential direction of the intermediate transfer medium 106 are produced at the upper and lower surfaces of the toner image. Consequently, a shearing stress is caused in the toner image. Thereby, the toner image is easily transferred from the intermediate transfer medium 106 to the surface of the recording medium 110, and the image is formed on the recording medium 110.

As described above, the pressure, heat and shearing stress act on the toner image in the region where the photosensitive body 101 contacts intermediate transfer medium 106 and in the region where the intermediate transfer medium 106 contacts the recording medium 110. Thus, the toner image can easily be released from the side that transfers it, and easily transferred to the side on which the toner image is to be transferred. Therefore, the transfer efficiency of the toner image can be enhanced.

In the step of transferring the toner image from the intermediate transfer medium 106 to the recording medium 110, if the press roller 109 is heated, the temperature of the toner image on the intermediate transfer medium 106 is prevented from lowering due to the contact with the recording medium 110, and the transfer efficiency is further enhanced.

Figure 24:
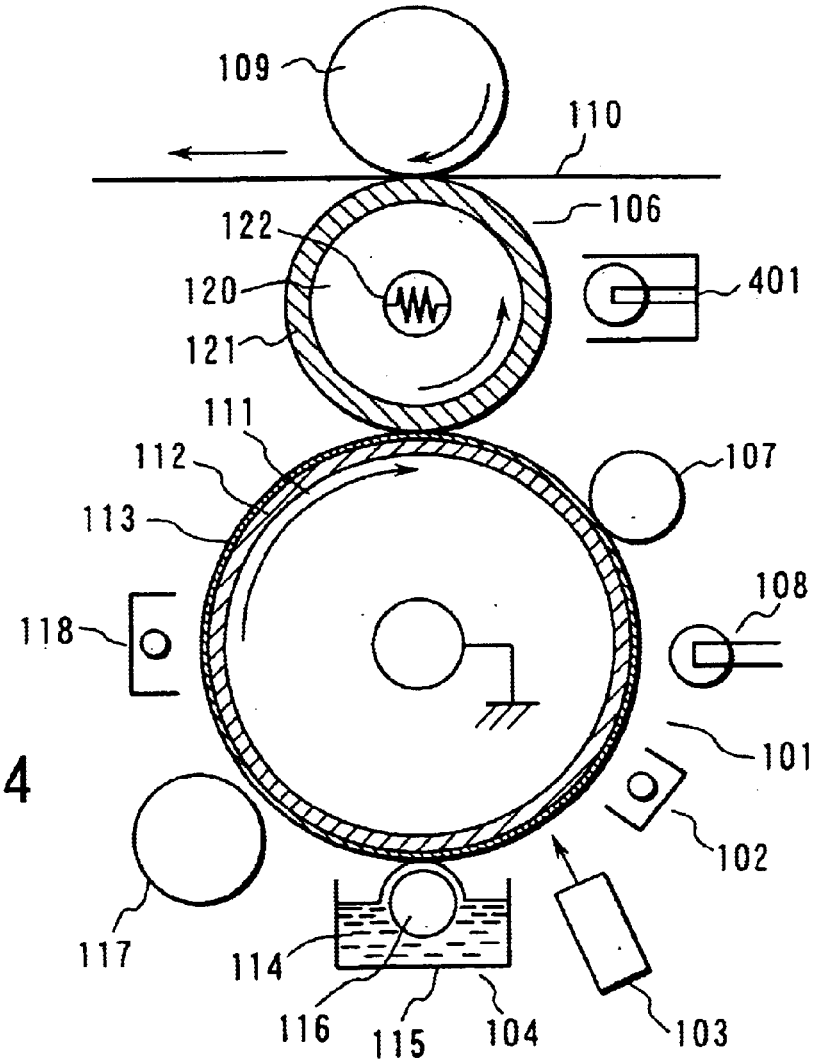
FIG. 24 shows the structure of an image forming apparatus according to a fifth embodiment of the invention.

FIG. 24 shows the structure of an image forming apparatus according to a fifth embodiment of the invention.

The same structural parts as those in the fourth embodiment are denoted by like reference numerals, and a description thereof is omitted.

In this embodiment, transfer of a toner image from the photosensitive body 101 to intermediate transfer medium 106 is effected by an electric field, and transfer of the toner image from the surface of intermediate transfer medium 106 to the recording medium 110 is effected by pressure and heat. The structure of this embodiment is the same as that shown in FIG. 21, except that toner image heating means 401 is provided in a non-contact state with the intermediate transfer medium 106.

Like the fourth embodiment, the toner image formed on the surface of release layer 113 of photosensitive body 101 is conveyed to the vicinity of the intermediate transfer medium 106 via the squeeze means 117 and toner image fixing unit 118. A gap of about 50 $\mu$m or less is provided between the photosensitive body 101 and intermediate transfer medium 106. The gap is filled with the solvent contained in the toner image formed on the surface of the release layer 113.

A voltage of about 600V is applied between the photosensitive body 101 and intermediate transfer medium 106, and toner particles in the toner image move to the surface of elastic layer 121 by electrophoresis. In this way, the toner image transferred on the intermediate transfer medium 106 is heated at 70° C. and condensed by the heat of the toner image heating means 119 and the heater 122 in the intermediate transfer medium 106. The condensed toner image is transferred on the recording medium 110 in the same operational mode as in the first embodiment, and a final image is obtained.

In this embodiment, too, a shearing stress acts between the intermediate transfer medium 106 and recording medium 110, and a high-quality image is obtained.

Figure 25:
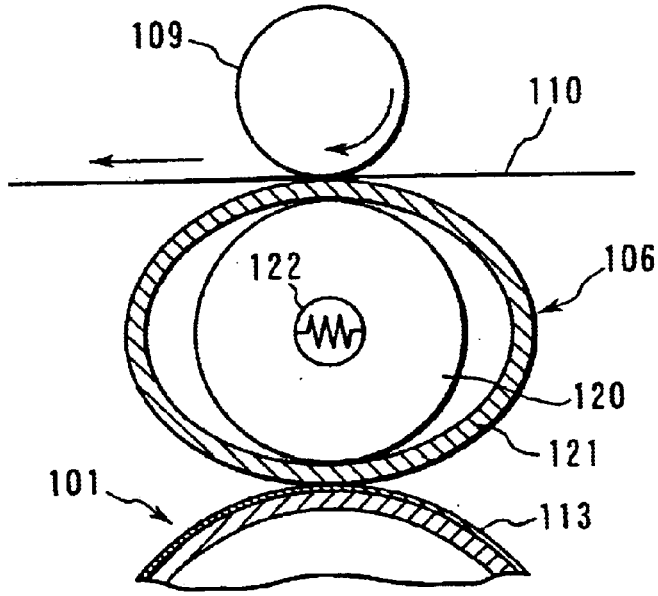
FIG. 25 shows the structure of an image forming apparatus according to a sixth embodiment of the invention.

FIG. 25 shows a sixth embodiment of the present invention, and is an enlarged view of a region corresponding to the region of the intermediate transfer medium 106 shown in FIG. 21.

The basic structure of the image forming apparatus of this embodiment is the same as that of the fourth embodiment. However, an elastic layer 121 of the intermediate transfer medium 106 is provided such that it is not fixed on the metallic roller 120. In addition, the photosensitive body 101, intermediate transfer medium 106 and press roller 109 have the same surface speed.

The operational principle of this embodiment will now be described with reference to FIGS. 26 to 28.

Figure 26:
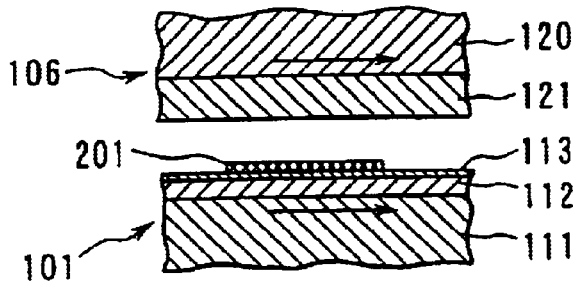
FIG. 26 illustrates the transfer of a toner image from the photosensitive body to the intermediate transfer medium.
Figure 27:
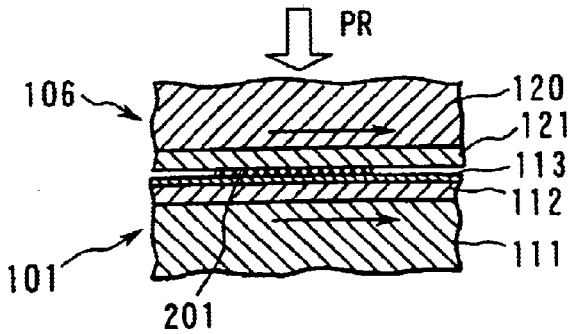
FIG. 27 illustrates the transfer of a toner image from the photosensitive body to the intermediate transfer medium.

As is shown in FIG. 26, the intermediate transfer medium 106 and photosensitive body 101 rotate so that the intermediate transfer medium 106 and the toner image 201 on the surface of release layer 113 may come into contact with each other. If the intermediate transfer medium 106 and photosensitive body 101 have come in contact, as shown in FIG. 27, a pressure PR acts to compress the elastic layer 121 on the surface of intermediate transfer medium 106 in the thickness direction. Since the elastic layer 121 is not fixed on the metallic roller 120, a force also acts in the tangential direction of the intermediate transfer medium 106 and the elastic layer 121 is extended in this direction. Thus, the elastic layer 121 contacts the toner image 201 on the surface of release layer 113 in the state in which the elastic layer 121 is extended in the tangential direction of intermediate transfer medium 106.

Figure 28:
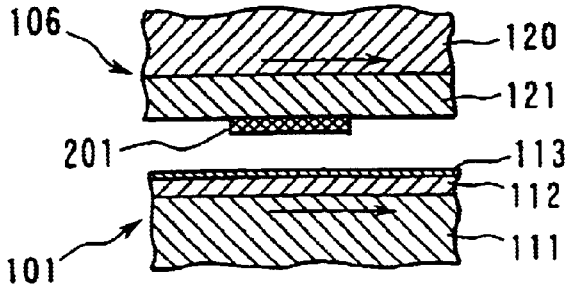
FIG. 28 illustrates the transfer of a toner image from the photosensitive body to the intermediate transfer medium.

If the intermediate transfer medium 106 and photosensitive body 101 have moved and gone out of contact, as shown in FIG. 28, the pressure that has acted on the elastic layer 121 is lost. Accordingly, the elastic layer 121 contracts in the tangential direction of intermediate transfer medium 106 and extends in the thickness direction.

Through the series of actions, a shearing stress acts at the interface between the release layer 113 and toner image 201 due to the contraction of the elastic layer 121. Consequently, the adhesive force of the toner image 201 on the release layer 113 decreases, and the toner image 201 is transferred from the release layer 113 onto the elastic layer 121.

Since the elastic layer 121 of intermediate transfer medium 106 is not fixed on the metallic roller 120, a large force can be produced in the tangential direction of intermediate transfer medium 106. Accordingly, the toner image 201 suffers not only the force in the thickness direction of elastic layer 121, but also the shearing stress in the tangential direction, and the transfer is facilitated.

The same applies to the transfer of the toner image from the intermediate transfer medium 106 to the recording medium 110. At their mutual contact point, the same shearing stress acts between the elastic layer 121 and recording medium 110, and the toner image can easily be transferred onto the recording medium 110.

If a highly extensible material is used for the elastic layer 121, a more effective shearing stress can be produced. The material of the elastic layer 121 may be properly chosen in consideration of the strength thereof.

For example, the elastic layer 121 should preferably have a hardness of about 40 to 60 defined by Type A of JIS K-6301, and a thickness of 0.1 mm to 1 mm.

In general terms, the pressure necessary for transfer from the photosensitive body 101 to intermediate transfer medium 106 is less than the pressure necessary for transfer from the intermediate transfer medium 106 to recording medium 110. For example, the former is about 20 kgf to about 60 kgf in terms of the A4 width, while the latter is about 40 kgf to about 100 kgf.

Figure 29:
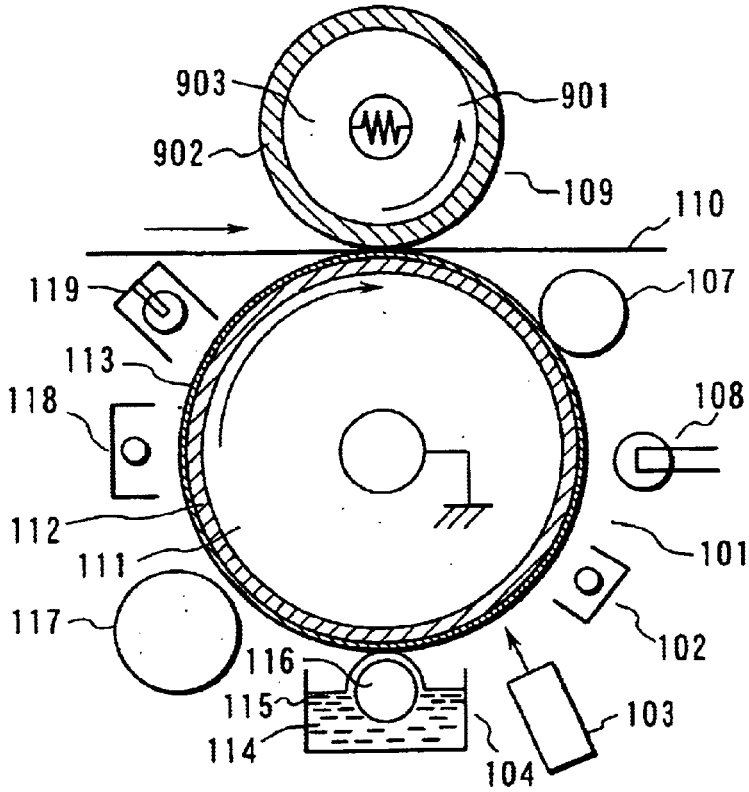
FIG. 29 shows the structure of an image forming apparatus according to a seventh embodiment of the invention.

FIG. 29 shows a seventh embodiment of the invention.

The same structural parts as those in the fourth embodiment are denoted by like reference numerals, and a description thereof is omitted.

In the image forming apparatus of this embodiment, the intermediate transfer medium is not used, and the toner image is directly transferred from the photosensitive body 101 to the recording medium 110 by pressure and heat. The press roller 109 comprises a metallic roller 901 and an elastic layer 902 formed thereon. A heater 903 is provided inside the press roller 109.

The condensed toner image formed on the release layer 113 through the same process as in the fourth embodiment is conveyed to the region where the release layer 113 contacts the recording medium 110. The toner image suffers a pressure equivalent to about 6 kgf to 10 kgf in terms of the A4 width.

The surface velocity of the press roller 109 is set to be lower than that of the photosensitive body 101. The velocity of recording medium 110 is set to be lower than that of the photosensitive body 101 by the frictional force acting between the press roller 109 and recording medium 110. With this setting, opposite-directional forces acting in the tangential direction of the photosensitive body 101 are produced at the upper and lower surfaces of the toner image. Consequently, a shearing stress is caused in the toner image.

Thus, in this case, too, where the toner image is directly transferred from the photosensitive body 101 to recording medium 110 by pressure and heat, the transfer efficiency can be enhanced by the effect of the shearing stress.

Figure 30:
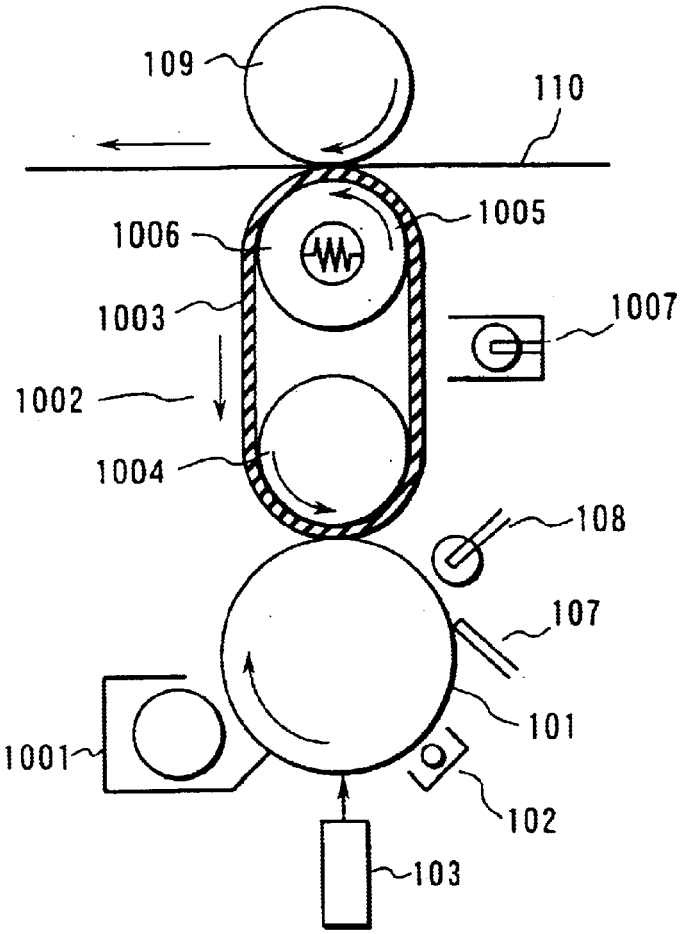
FIG. 30 shows the structure of an image forming apparatus according to an eighth embodiment of the invention.

FIG. 30 shows an eighth embodiment of the invention.

This embodiment employs a dry image forming method. A toner image is transferred on an intermediate transfer medium, and the toner image is then transferred from the intermediate transfer medium to a recording medium.

The image forming apparatus of this embodiment comprises a photosensitive body 101, a charger 102 for uniformly charging the surface of the photosensitive body 101, and an optical unit 103 for illuminating image signal light to the charged surface and forming an electrostatic latent image.

The image forming apparatus also comprises developing means 1001 for supplying powder toner and forming a toner image on the release layer 113 on the surface of the photosensitive body 101, an intermediate transfer medium 1002 for transferring the toner image, charge erase means 108 for removing the charge from the surface of photosensitive body 101, and cleaning means 107 for recovering residual toner on the release layer 113 on the surface of photosensitive body 101.

The press roller 109, which contacts the intermediate transfer medium 1002 to apply pressure, should preferably include a heater therein. A recording medium 110 is conveyed between the intermediate transfer medium 1002 and press roller 109.

The intermediate transfer medium 1002 comprises a first transfer roller 1004, a second transfer roller 1005, and an intermediate transfer belt 1003 passed over the first and second transfer rollers 1004, 1005. The intermediate transfer belt 1003 is formed of the same material as the elastic layer 121 in the fourth embodiment. Preferably, the material of the intermediate transfer belt 1003 should have a resistance of about $10^{10}$ to $10^{12}$ Ωcm.

The second transfer roller 1005 includes therein a heater 1006 such as a halogen lamp, and rotates at the surface velocity of the press roller 109.

The apparatus also includes toner image heating means 1007 for melting the toner image while the intermediate transfer belt 1003 is moving from the contact point with the release layer 113 to the contact point with the recording medium 110. The toner image heating means 1007 may be a light illumination means provided in a non-contact state, or a heat controller including a heater, which is put in contact with the intermediate transfer belt 1003.

The image forming process applied to the image forming apparatus of this embodiment will now be described.

Through an ordinary dry image forming process, a toner image is formed on the surface of release layer 113 using powder toner. A predetermined transfer voltage is applied to the first transfer roller 1004. The toner image is transferred onto the surface of the intermediate transfer belt 1003 by an electric field produced between the photosensitive body 101 and intermediate transfer belt 1003. The toner image transferred on the surface of the intermediate transfer belt 1003 is heated and melted while passing by the toner image heating means 1007. The heated toner image suffers a pressure acting between the intermediate transfer belt 1003 supported by the second transfer roller 1005 and the recording medium 110 pressed by the press roller 109. In addition, the toner image suffers a shearing stress in the rotational direction of the rollers 1005, 109 due to a difference in velocity between the rollers 1005, 109. Thereby, the toner image on the intermediate transfer belt 1003 is easily transferred on the recording medium 110, and a final image is fixed on the recording medium 110.

In the dry image forming apparatus using powder toner as developer, the toner image is normally in the powder state until it is thermally fixed on the surface of the recording medium. In this embodiment, the toner image is thermally melted during the process. Thus, disturbance of the image due to dispersion of toner at the time of transfer can be prevented, and a high-quality image can be obtained.

The molten toner image can easily be transferred by the effect of the shearing stress acting in the toner image, as in the present embodiment.

Figure 31:
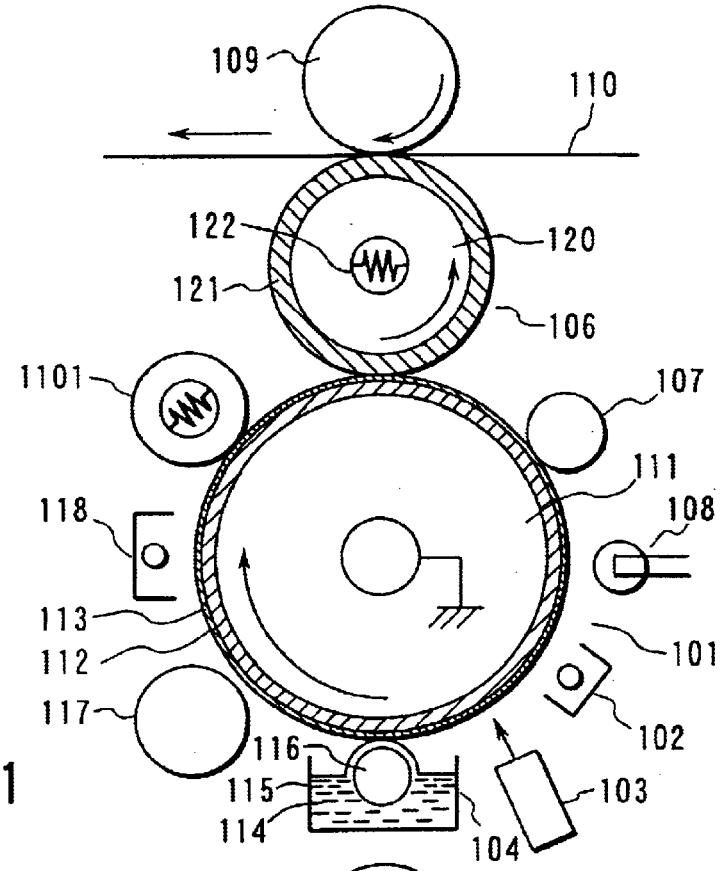
FIG. 31 shows the structure of an image forming apparatus according to a ninth embodiment of the invention.

FIG. 31 shows a ninth embodiment of the invention.

In the fourth embodiment, as shown in FIG. 21, the toner image heating means 119 is provided in a non-contact state with the photosensitive body 101. In this embodiment, however, a roller 1101 including a heater therein is used.

The surface of the roller 1101 is formed of a material such as silicone resin, to which a toner image hardly adheres. The roller 1101 is pressed on the surface of the photosensitive body 101 under a pressure equivalent to about 10 kgf in terms of the A4 width, which does not disturb the toner image.

Figure 32:
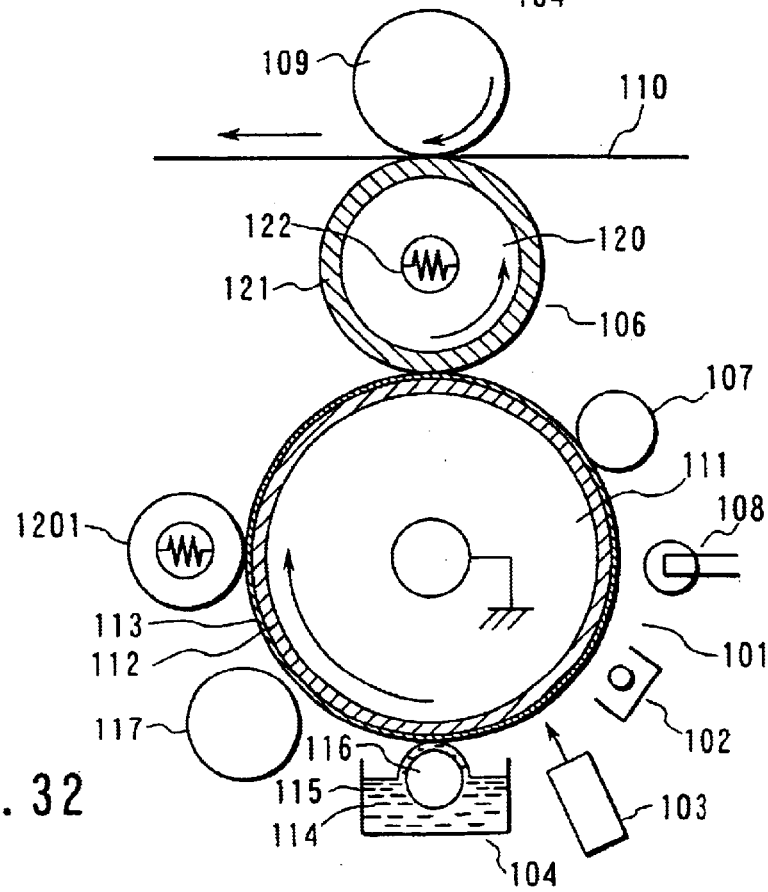
FIG. 32 shows the structure of an image forming apparatus according to a tenth embodiment of the invention.

FIG. 32 shows a tenth embodiment of the invention.

In the tenth embodiment, the toner image heating means shown in FIG. 21, which is provided in a non-contact state, is replaced with toner image heating means 1201 constituted by a roller. A voltage is applied to the toner image heating means 1201. Thereby, both the fixation of the toner image by voltage and the condensation by heat can be performed at the same time. By virtue of this structure, the toner image can be condensed without disturbance, without the need to provide the toner image fixing means.

In the above-described embodiments, the photosensitive body has been exemplified as the electrostatic latent image carrying body. In this invention, the electrostatic latent image carrying body is not limited to the photosensitive body. For example, a base plate or a drum having a non-photosensitive insulating layer on its surface can be used.

In this case, the charging means and exposing means may be replaced by a means capable of applying charge in accordance with image signals, such as an ion flow head. Thereby, an electrostatic latent image can be formed on the surface of the electrostatic latent image carrying body. Besides, the subsequent process including the development step may be the same as the process applied to the apparatus using the photosensitive body.

As has been described above, according to the image forming apparatus of the present invention, the shearing stress is caused in the toner image at the time of transfer of the toner image. Therefore, the transfer efficiency of the toner image can be enhanced, and a stable image can be formed on the recording medium.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a latent image forming device which forms an electrostatic latent image on a surface of an electrostatic latent image carrying body;

a developing device which supplies a liquid developer on the electrostatic latent image formed by the latent image forming device, and develops the electrostatic latent image into a developer image; and a transfer device which transfers the developer image developed by the developing device from the electrostatic latent image carrying body to an intermediate transfer medium, and then transfers the developer image from the intermediate transfer medium to a recording medium, wherein the intermediate transfer medium, while rotating, transfers the developer image to the recording medium, and there is a difference in surface velocity between the intermediate transfer medium and the recording medium, wherein when the surface velocity of the intermediate transfer medium is v2 and the surface velocity of the recording medium is v3, the relationship, $0.95<v3/v2<0.99$, is satisfied.

2. An image forming apparatus according to claim 1, wherein a contact pressure between the latent image carrying body and the intermediate transfer medium is 0.1 to 20 kg/cm in terms of a line-pressure.

3. An image forming apparatus according to claim 1, wherein a contact pressure between the intermediate transfer medium and the recording medium is 0.2 to 20 kg/cm in terms of a line-pressure.

* * * * *